US009759533B2

(12) United States Patent
Bruno

(10) Patent No.: US 9,759,533 B2
(45) Date of Patent: Sep. 12, 2017

(54) LOW COLLATERAL DAMAGE BI-MODAL WARHEAD ASSEMBLY

(71) Applicant: NOSTROMO HOLDINGS, LLC, Alexandria, VA (US)

(72) Inventor: Nicolas Horacio Bruno, Cordoba (AR)

(73) Assignee: NOSTROMO HOLDINGS, LLC, Alexandria, VA (US)

( * ) Notice: Subject to any disclaimer, the term of this patent is extended or adjusted under 35 U.S.C. 154(b) by 0 days.

(21) Appl. No.: 15/057,206

(22) Filed: Mar. 1, 2016

(65) Prior Publication Data

US 2016/0258727 A1 Sep. 8, 2016

Related U.S. Application Data

(60) Provisional application No. 62/126,767, filed on Mar. 2, 2015.

(51) Int. Cl.
*F42B 12/32* (2006.01)
*F42B 12/24* (2006.01)

(52) U.S. Cl.
CPC ..... *F42B 12/32* (2013.01); *F42B 12/24* (2013.01)

(58) Field of Classification Search
CPC ..... F42B 12/32; F42B 12/24
USPC ..... 102/495
See application file for complete search history.

(56) References Cited

U.S. PATENT DOCUMENTS 447,229 A * 2/1891 Cayley ..... F42B 12/32 102/494
603,525 A * 5/1898 Darmancier ..... F42B 12/32 102/494
658,231 A * 9/1900 Bickel ..... F42B 12/32 102/494
723,256 A * 3/1903 Emery ..... F42B 12/32 102/494
735,658 A * 8/1903 Dunn ..... F42B 12/32 102/494
775,640 A * 11/1904 Van Essen ..... F42B 12/32 102/494
791,679 A * 6/1905 Edmunds ..... F42B 12/32 102/495
1,006,875 A * 10/1911 Coller ..... F42B 12/32 102/494
1,042,176 A * 10/1912 Puff ..... F42B 12/32 102/494

(Continued)

FOREIGN PATENT DOCUMENTS

DE 4139372 C1 11/1991
DE 19524726 A1 7/1995

(Continued)

*Primary Examiner* — Joshua Freeman
(74) *Attorney, Agent, or Firm* — Karl F. Milde, Jr.; Eckert Seamans Chenn & Mellott, LLC

(57) ABSTRACT

A warhead assembly, comprising a cylindrical or conical metal body, having an inner wall with a plurality of channels or grooves extending parallel to a central longitudinal axis. Preformed fragments are inserted in the channels or grooves and a liner with an explosive fill is positioned within the metal body, retaining the preformed fragments in place. The warhead assembly on detonation produces a bimodal distribution of fragments with adequate mass and velocity with optimized mixed fragmentation that defeats or otherwise incapacitates a target or set of targets.

14 Claims, 22 Drawing Sheets

Cross Sectional View of a 155mm Warhead Assembly

(56) References Cited

U.S. PATENT DOCUMENTS 3,491,694 A 1/1970 Fountain
3,498,224 A * 3/1970 Cordle ..... F42B 12/22 102/496
3,566,794 A 3/1971 Pearson et al.
3,799,054 A 3/1974 LaRocca
3,945,321 A * 3/1976 Mayer ..... F42B 12/32 102/496
4,016,816 A * 4/1977 Larsson ..... F42B 12/32 102/494
4,037,539 A 7/1977 Hackman
4,129,061 A * 12/1978 Bedall ..... F42B 12/32 102/496
4,242,960 A 1/1981 Boeder et al.
4,296,180 A * 10/1981 Rhau ..... B21K 21/06 102/474
4,303,015 A * 12/1981 Bourlet ..... F42B 12/44 102/492
4,305,333 A 12/1981 Altenau et al.
4,312,274 A 1/1982 Zernow
4,327,643 A * 5/1982 Lasheras Barrios .... F42B 12/32 102/473
4,351,239 A * 9/1982 McCubbin ..... F42B 12/44 102/364
4,351,240 A * 9/1982 McCubbin ..... F42B 12/44 102/364
4,381,692 A * 5/1983 Weintraub ..... F42B 12/44 102/364
4,516,501 A 5/1985 Held et al.
4,592,283 A * 6/1986 Hellner ..... F42B 12/22 102/493
4,655,139 A * 4/1987 Wilhelm ..... F42C 19/095 102/309
4,658,727 A 4/1987 Wilhelm et al.
4,662,281 A 5/1987 Wilhelm et al.
4,664,035 A 5/1987 Osofsky
4,745,864 A 5/1988 Craddock
4,776,272 A 10/1988 Lindstadt et al.
4,823,701 A 4/1989 Wilhelm
5,313,890 A 5/1994 Cuadros
5,337,673 A 8/1994 Koontz et al.
5,375,523 A 12/1994 Morris
5,544,589 A 8/1996 Held
5,813,219 A 9/1998 Gill et al.
5,979,332 A * 11/1999 Hammer ..... F42B 12/32 102/496
6,276,278 B1 * 8/2001 Korpe ..... F42C 13/04 102/492
6,484,642 B1 11/2002 Kuhns et al.
6,615,737 B2 9/2003 Bonnel et al.
6,857,372 B2 2/2005 Renaud-Bezot et al.
7,114,449 B2 10/2006 Altenau
7,451,704 B1 11/2008 Gold et al.
7,621,222 B2 11/2009 Lloyd
7,624,682 B2 12/2009 Lloyd
7,624,683 B2 12/2009 Lloyd
7,739,956 B2 6/2010 Ljungwald et al.
7,743,707 B1 6/2010 Melin et al.
7,886,667 B1 2/2011 Baker et al.
2005/0087088 A1 * 4/2005 Lacy ..... F42B 12/32 102/495
2010/0064926 A1 3/2010 Melin et al.
2010/0175575 A1 * 7/2010 Amick ..... F42B 7/046 102/460
2010/0199875 A1 * 8/2010 Weihrauch ..... F42B 12/208 102/492
2016/0363426 A1 * 12/2016 Kerns ..... F42B 12/204

FOREIGN PATENT DOCUMENTS

GB 133076 * 10/1919
GB 2251480 * 8/1992

* cited by examiner

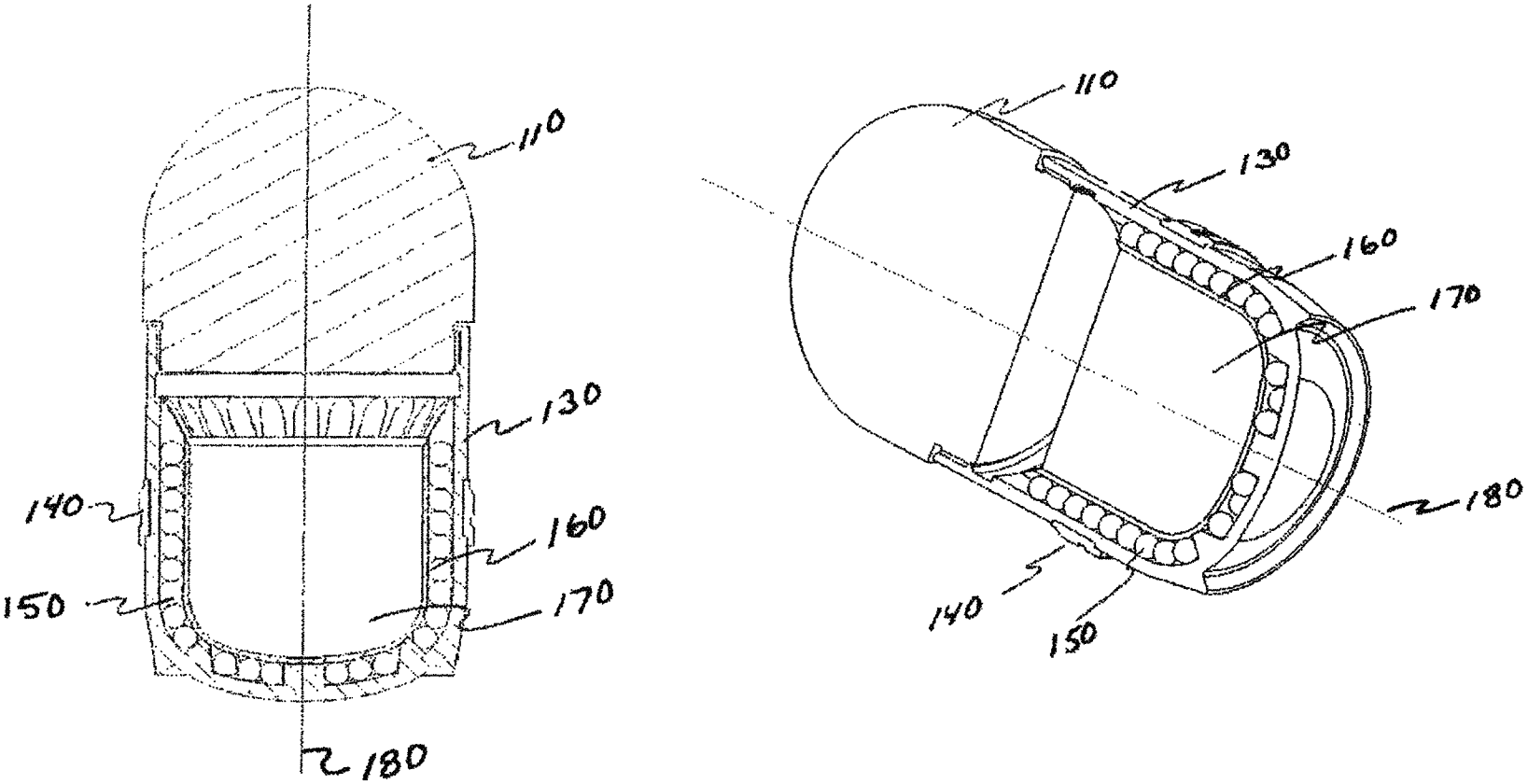
Figure 1A – Cut Away Views 40mm Warhead (Assembly)

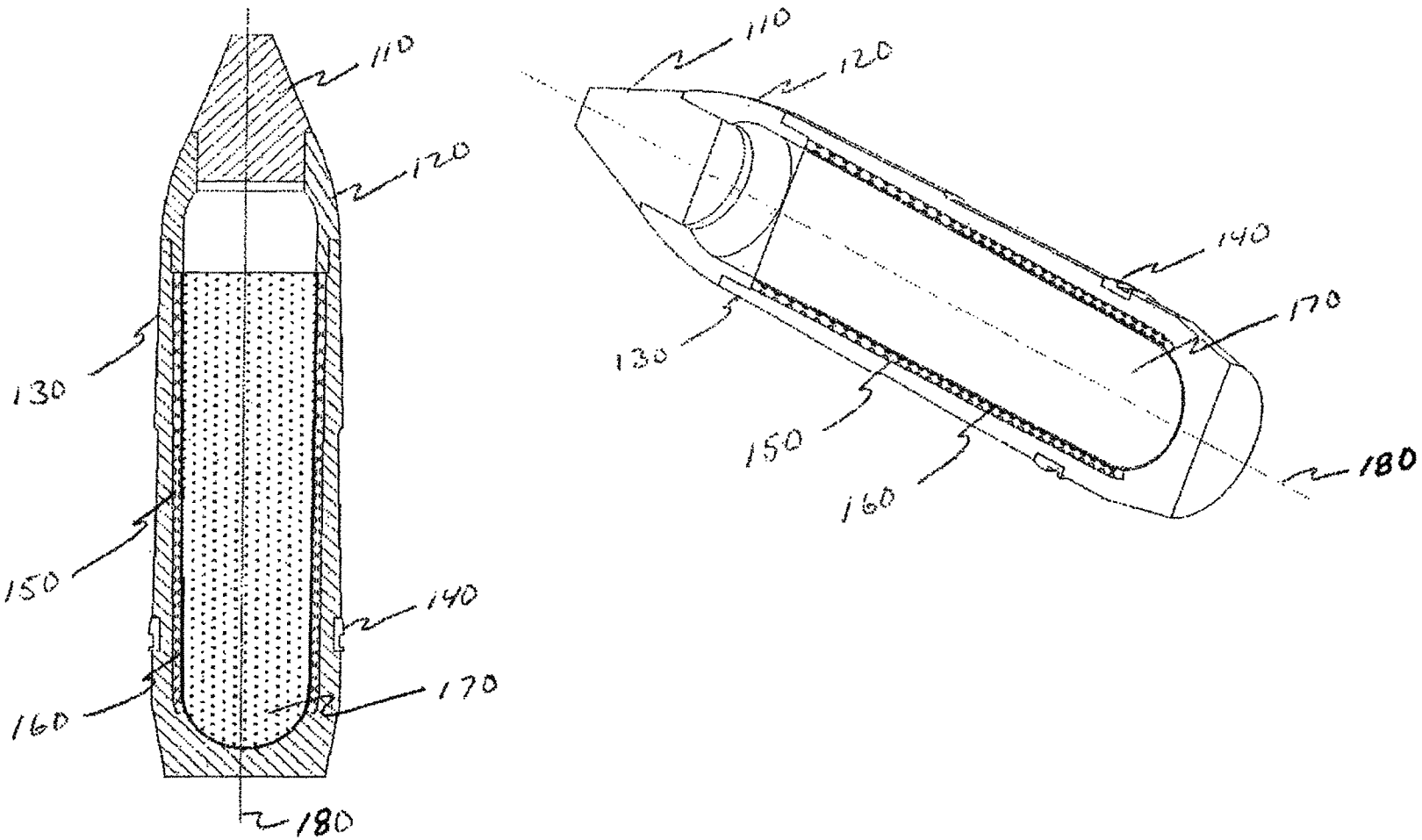
Figure 1B – Cut Away Views 105mm Warhead (Assembly)

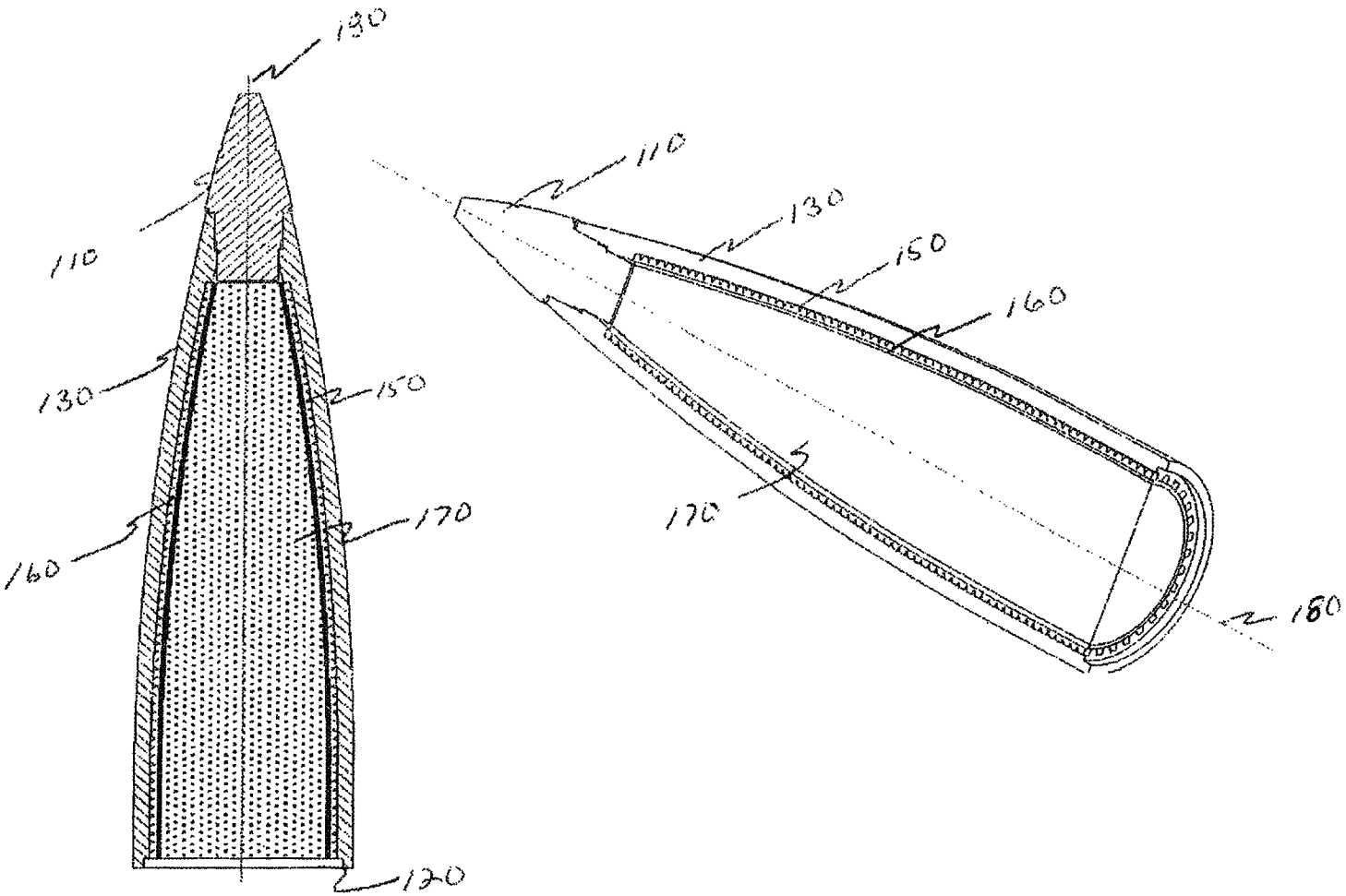
Figure 1C – Cut Away Views 155mm Warhead (Assembly)

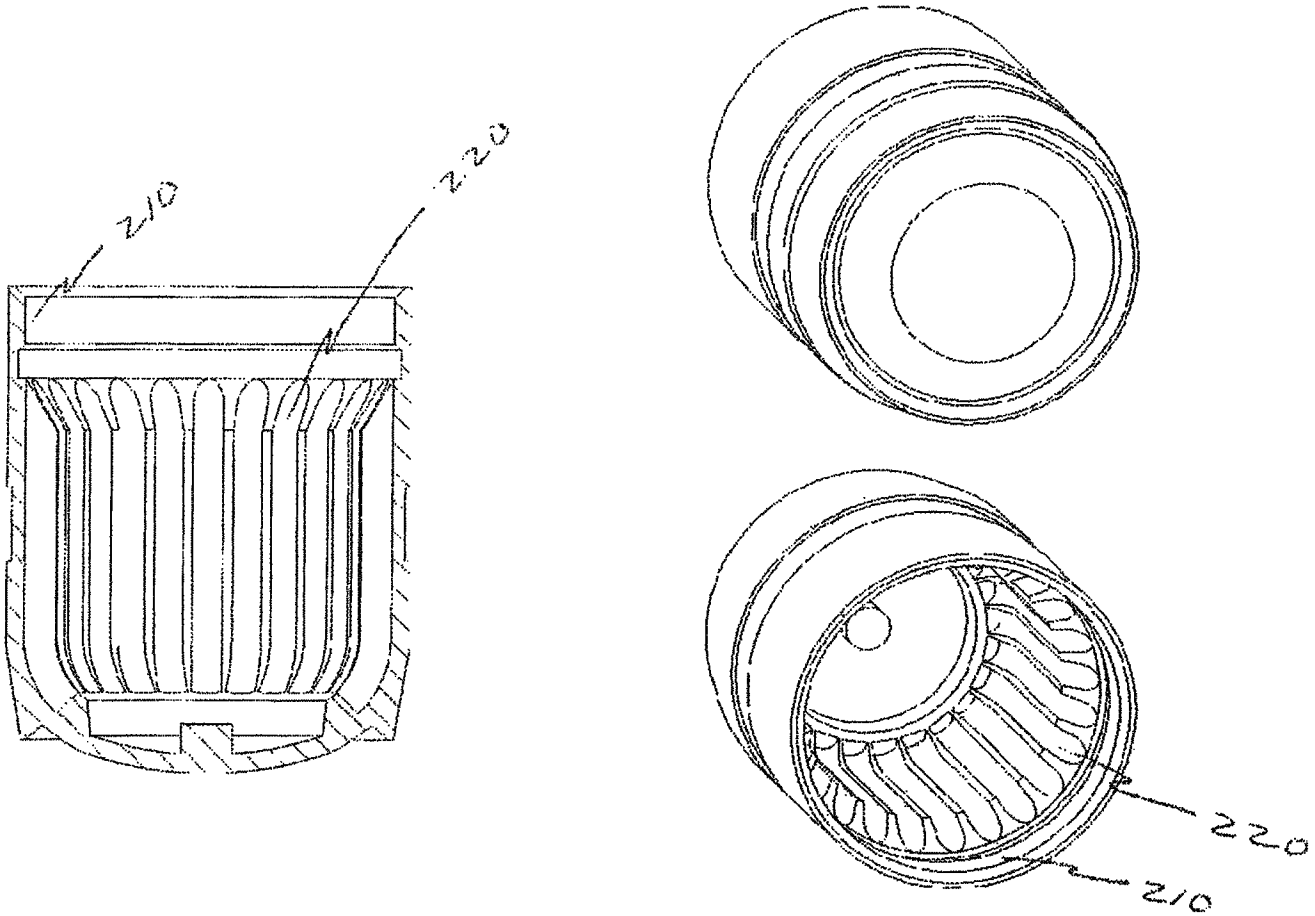
2A Views of 40mm Warhead Body with Internal Grooves

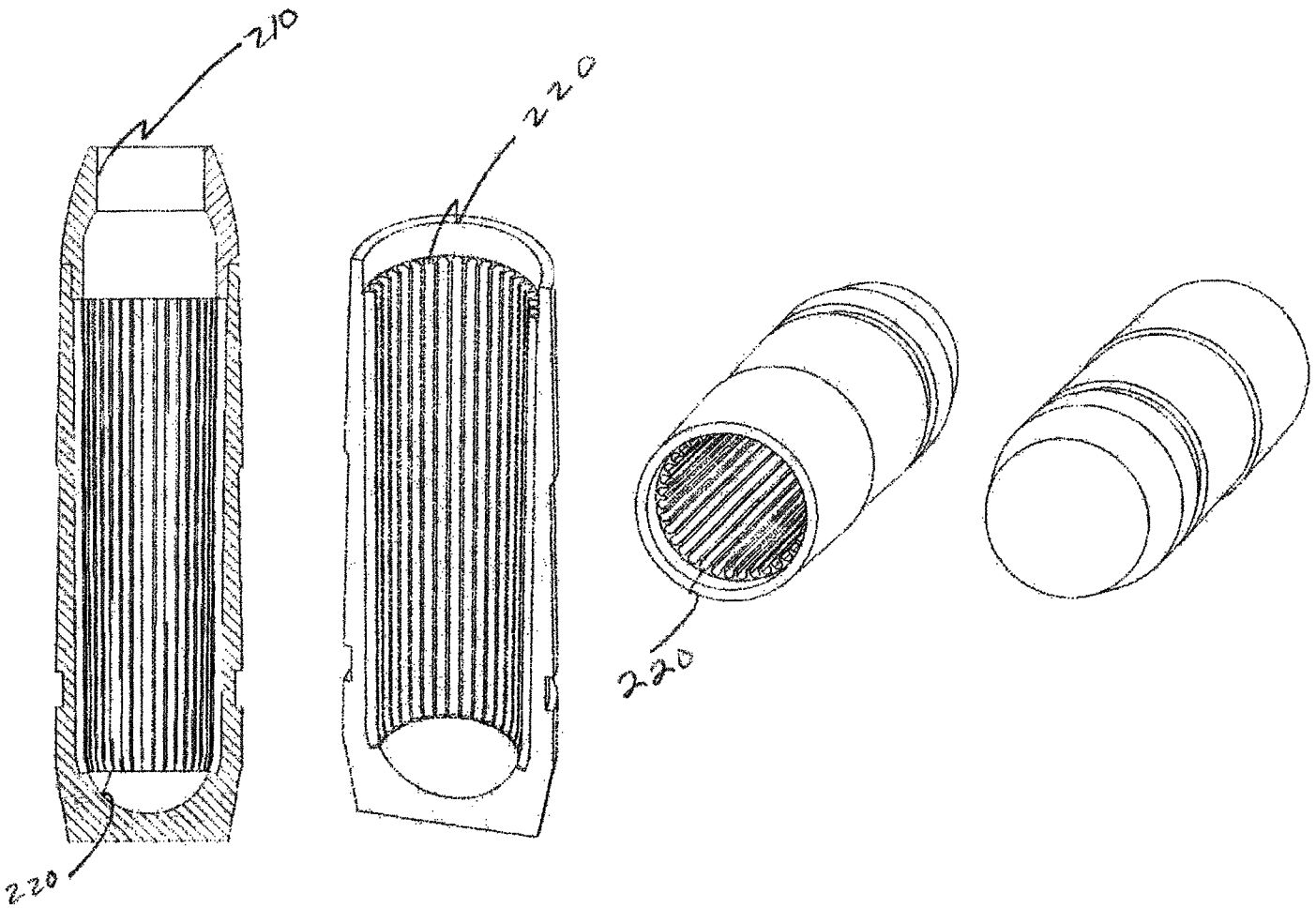
2B – Views of 105mm Warhead Body with Internal Grooves

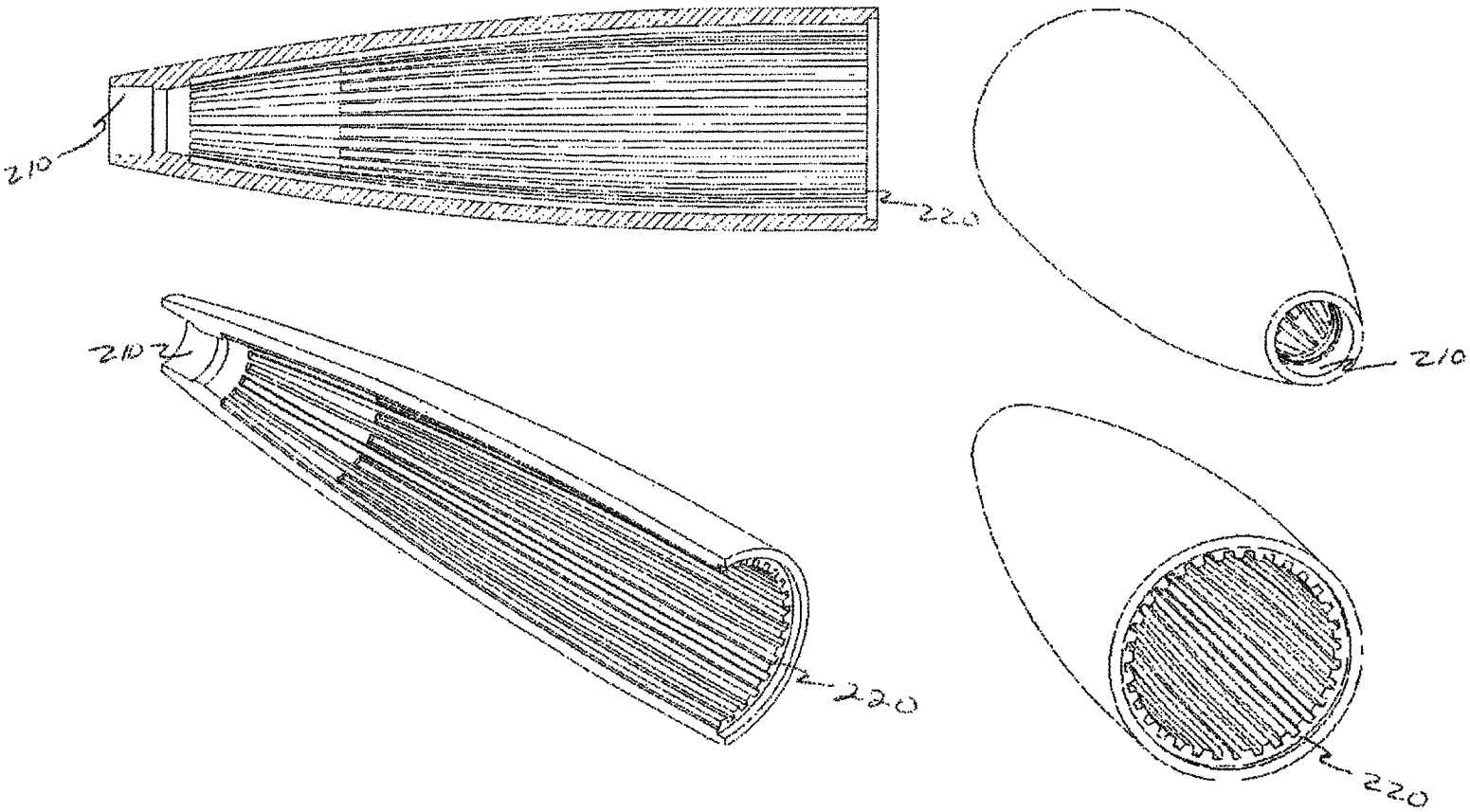
2C Views of 155mm Warhead Body with Channels

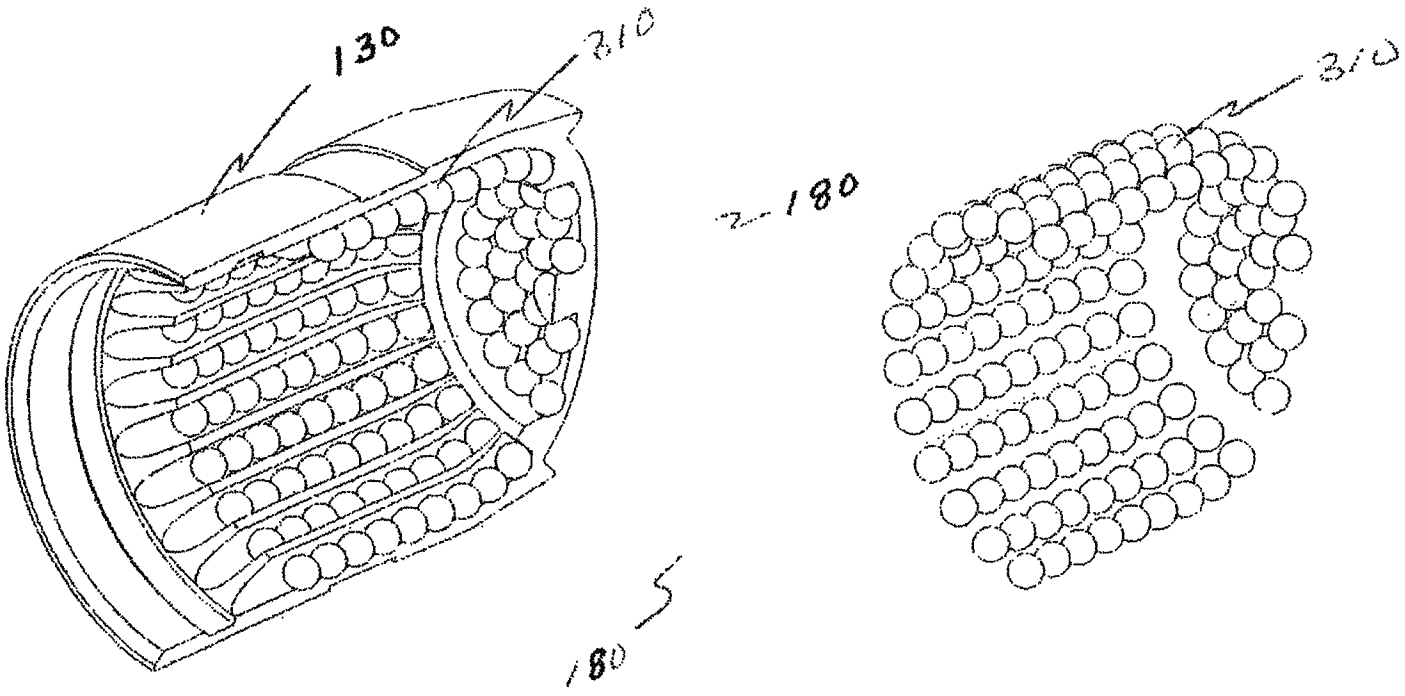
3A Views of 40mm Projectile with Spherical Pre-fragments

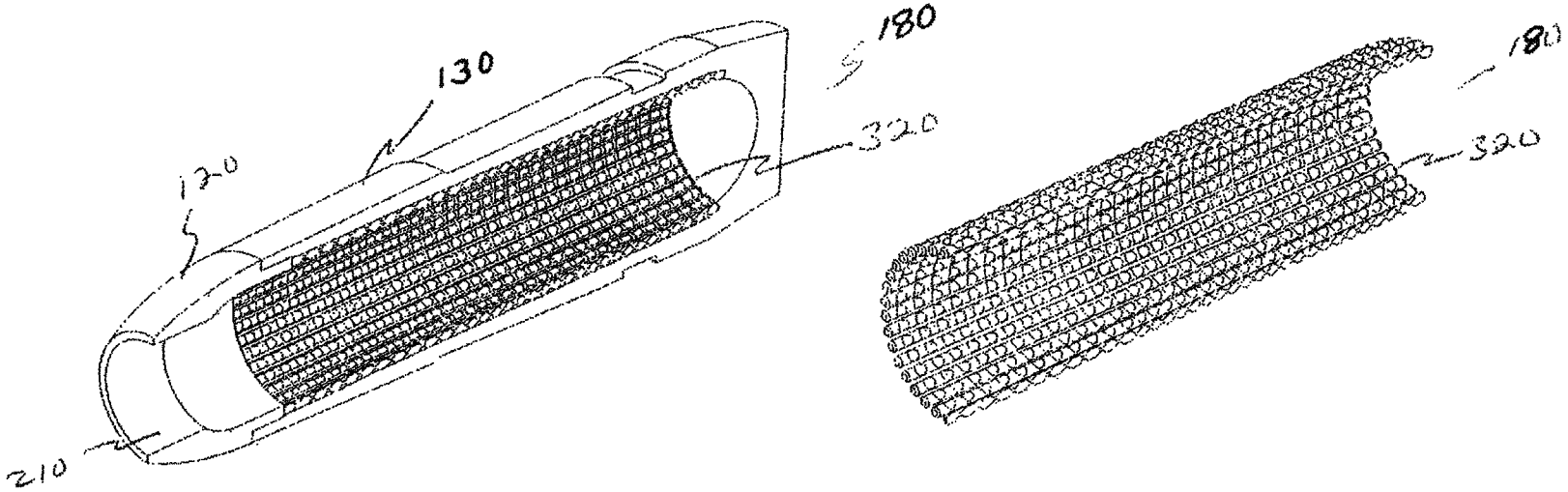
3B View of 105mm Projectile with Cylindrical or Notched Wire Pre-Fragments

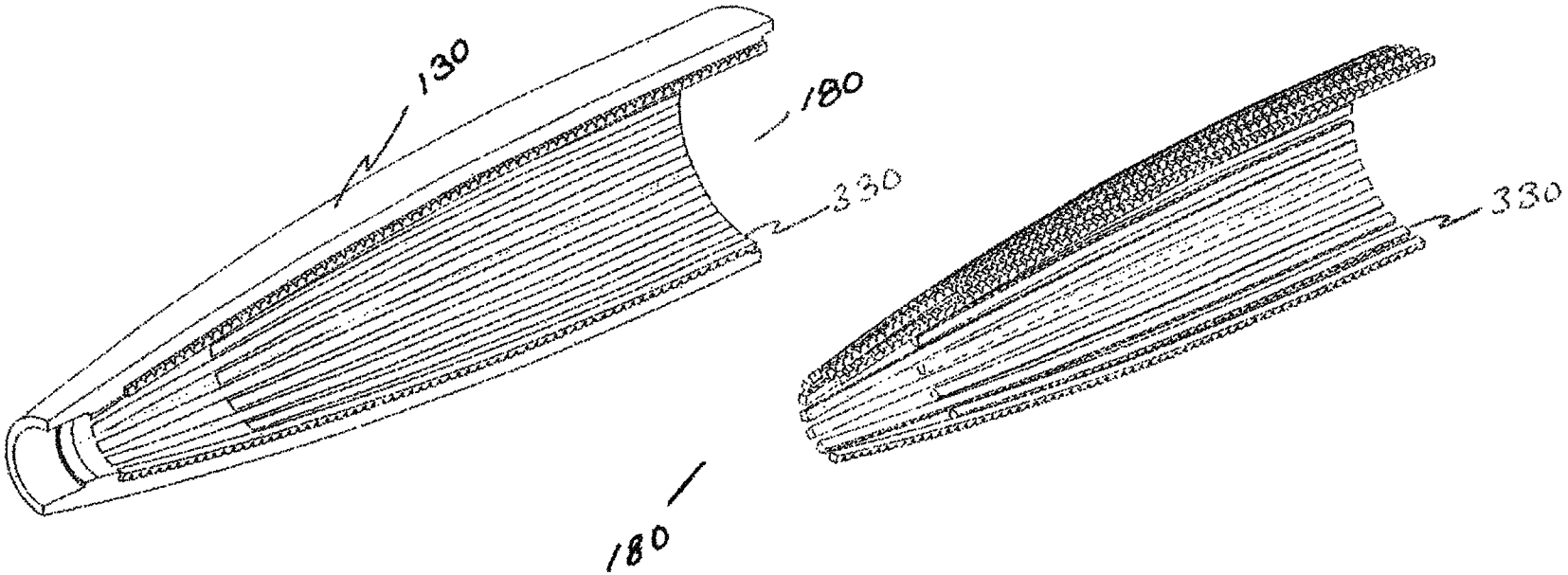
3C View of 155mm Projectile with Notched Rods

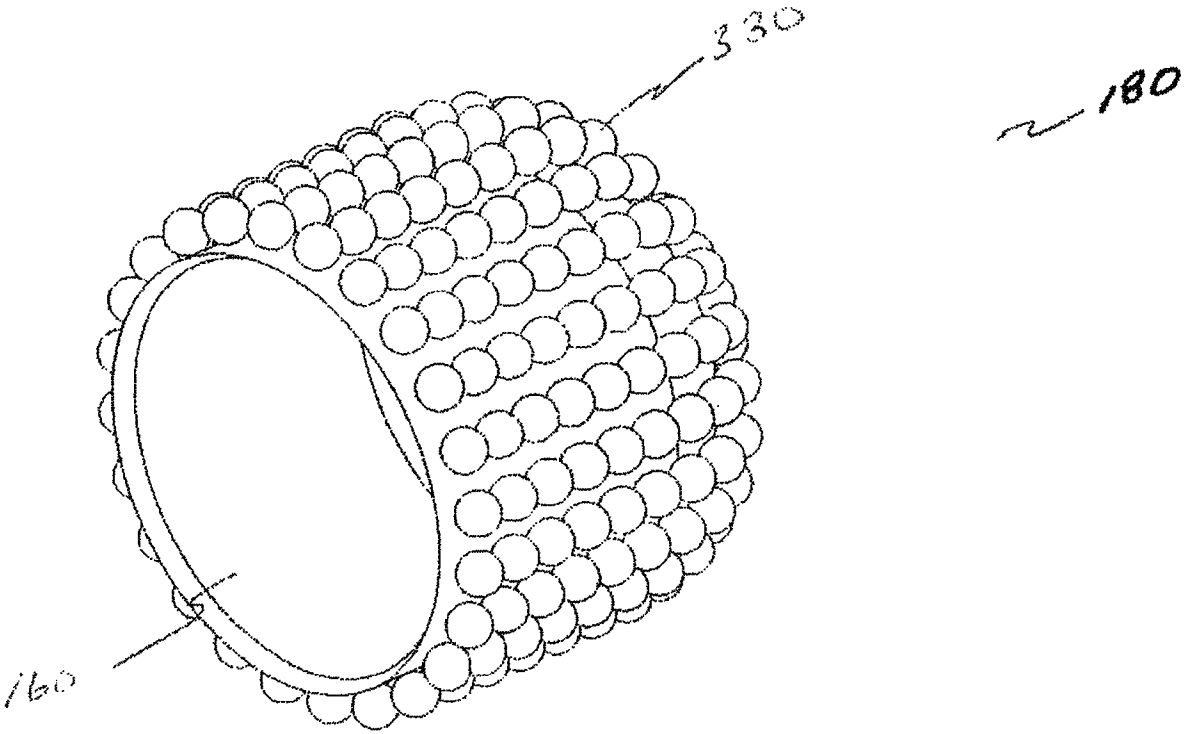
4A – View of 40mm Liner and Spherical Pre-fragments

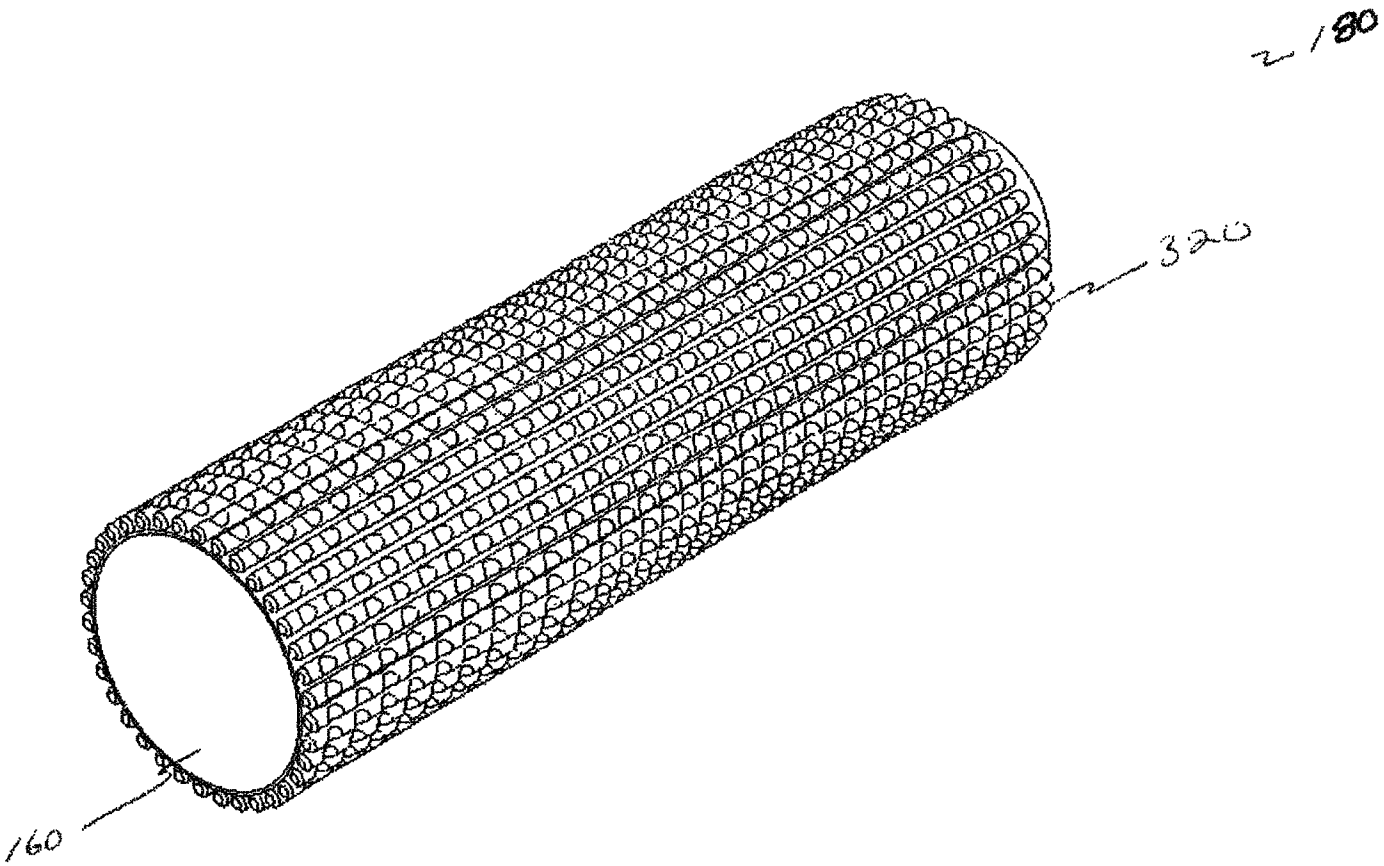
4B – View of 105mm Liner and Cylindrical or Notched Wire Pre-Fragments

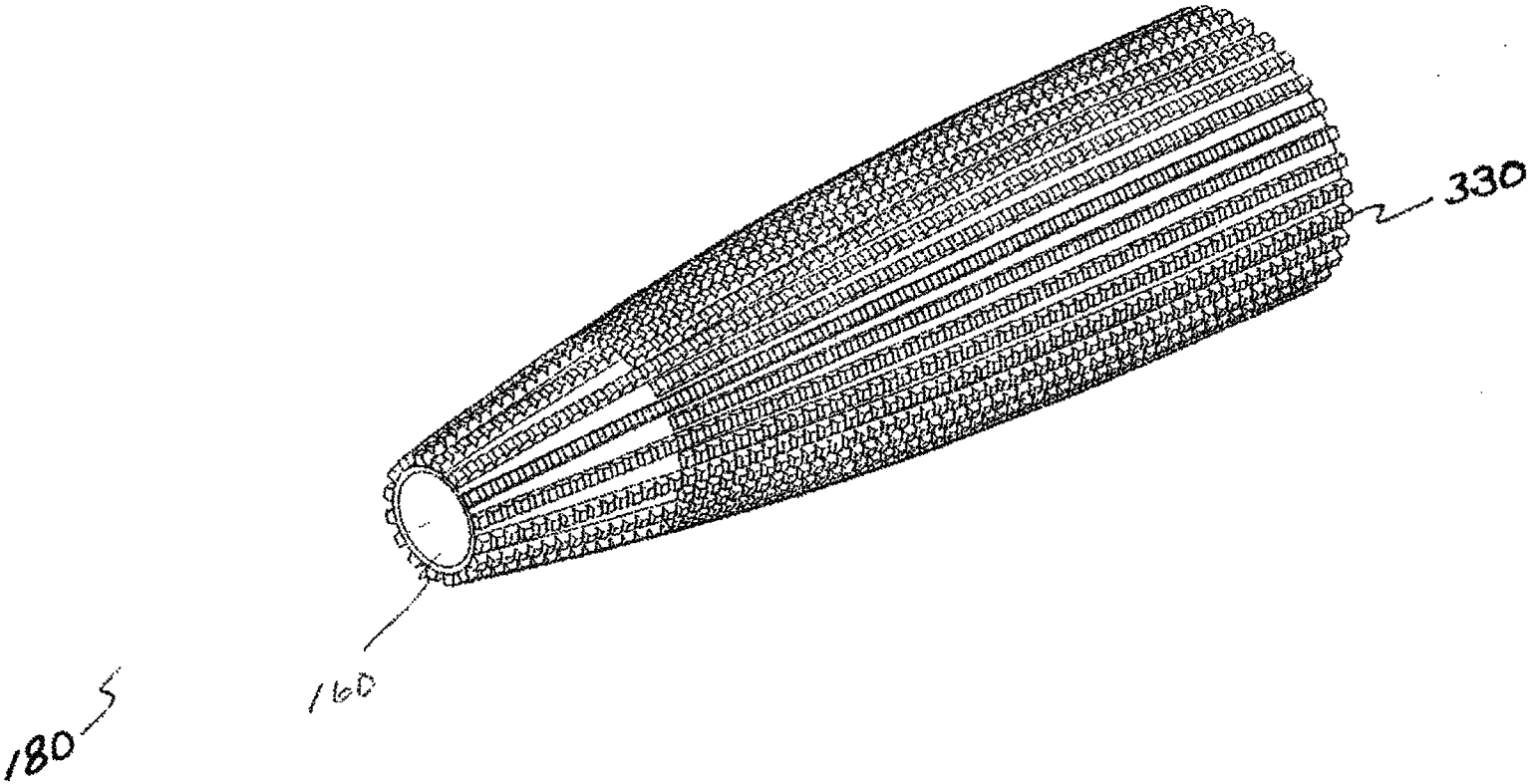
4C – View of 155mm with Notched Rods

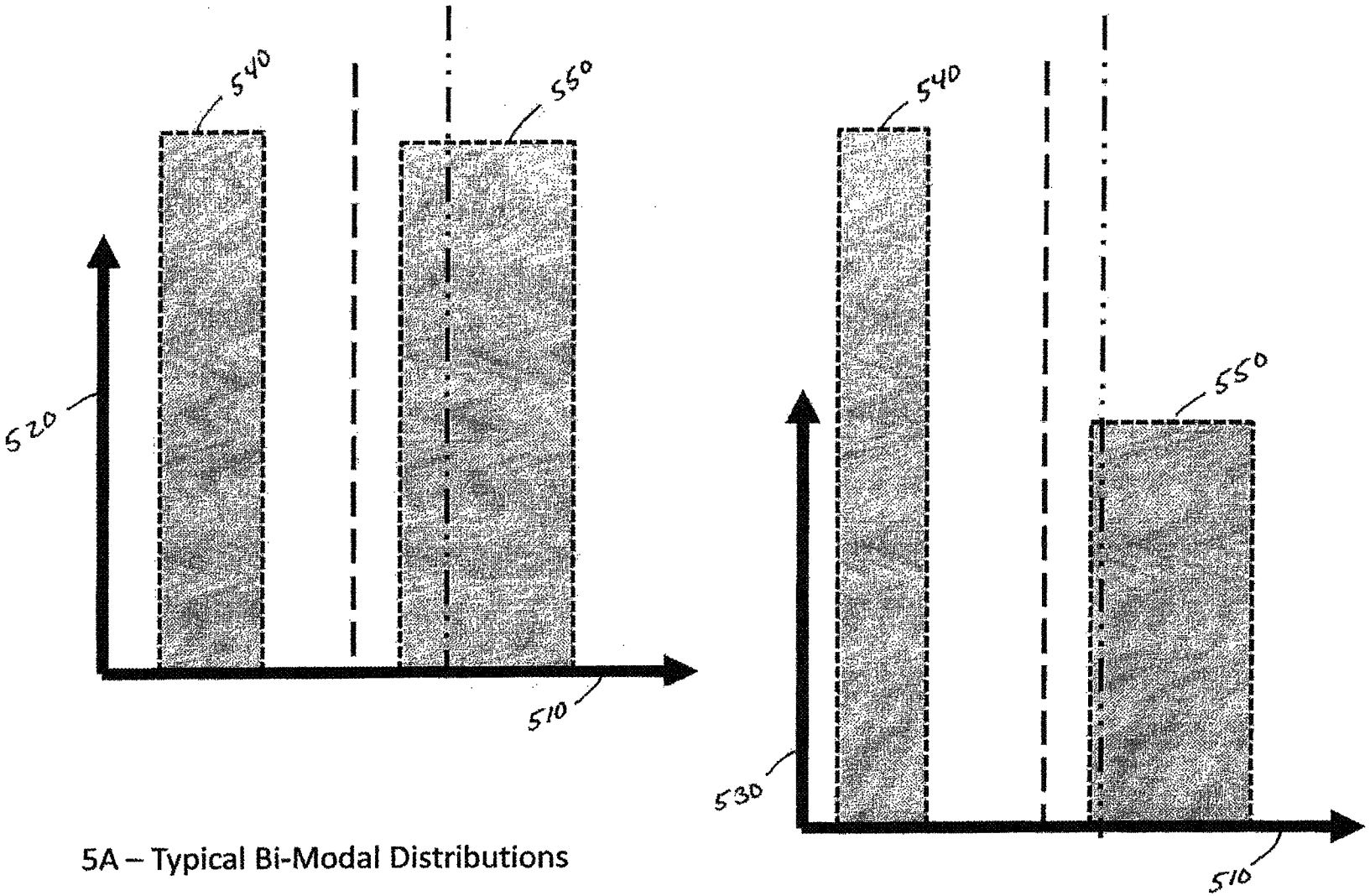
5A – Typical Bi-Modal Distributions

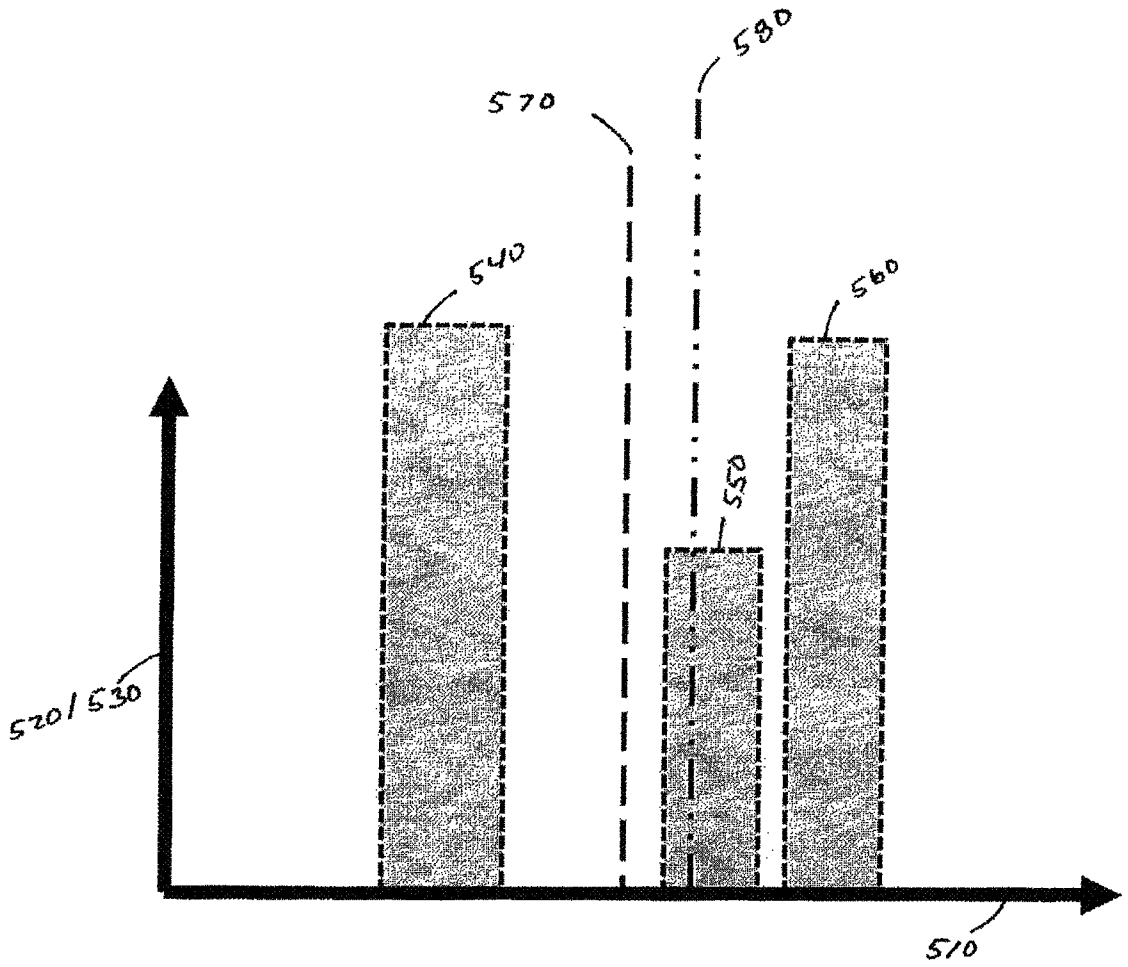
5B – Typical Multi-Modal Distributions

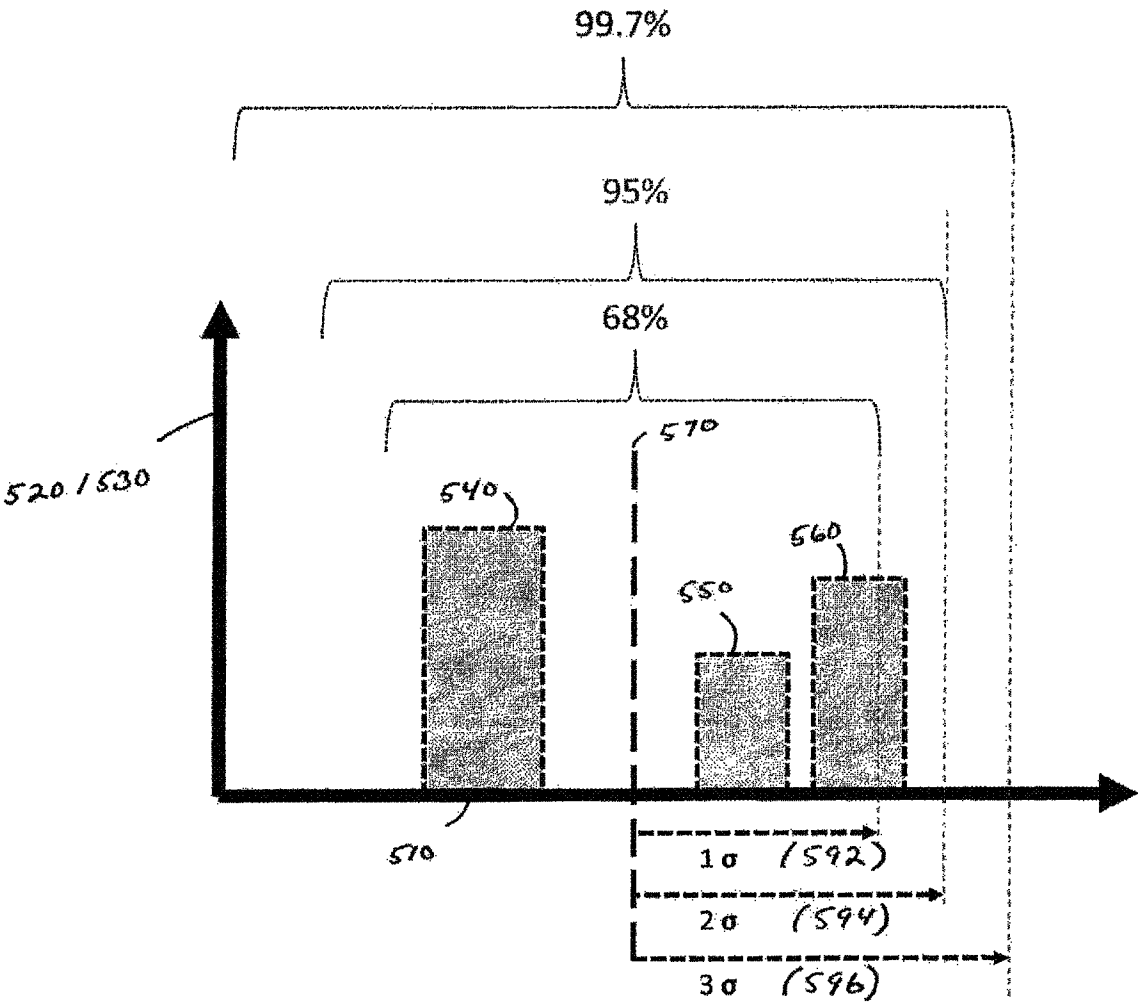
5C – Multi-Modal Distribution with Confidence Levels

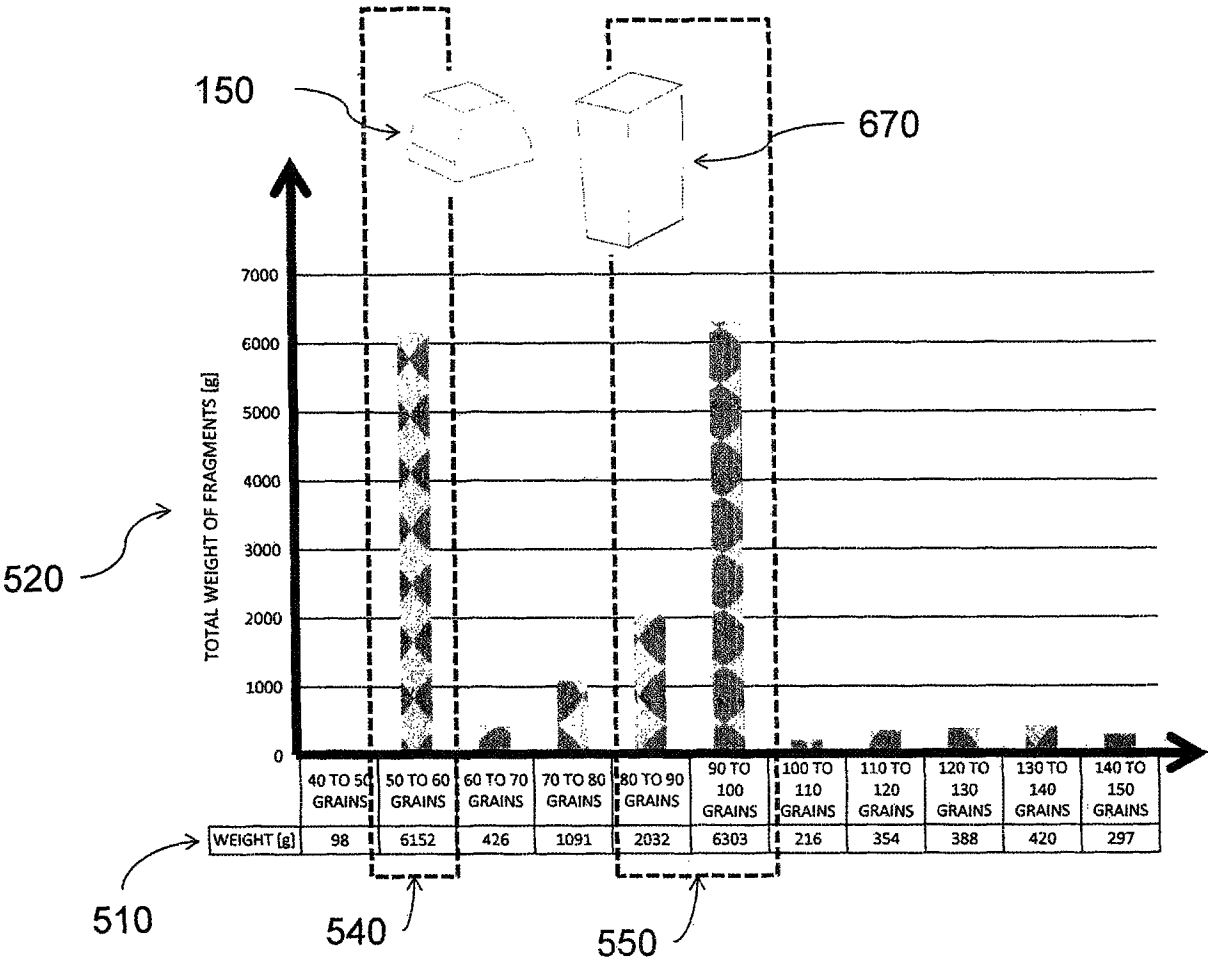
Figure 5D - Estimated 155mm Fragment Mass/Weight Distribution (total fragment Mass/Weight)

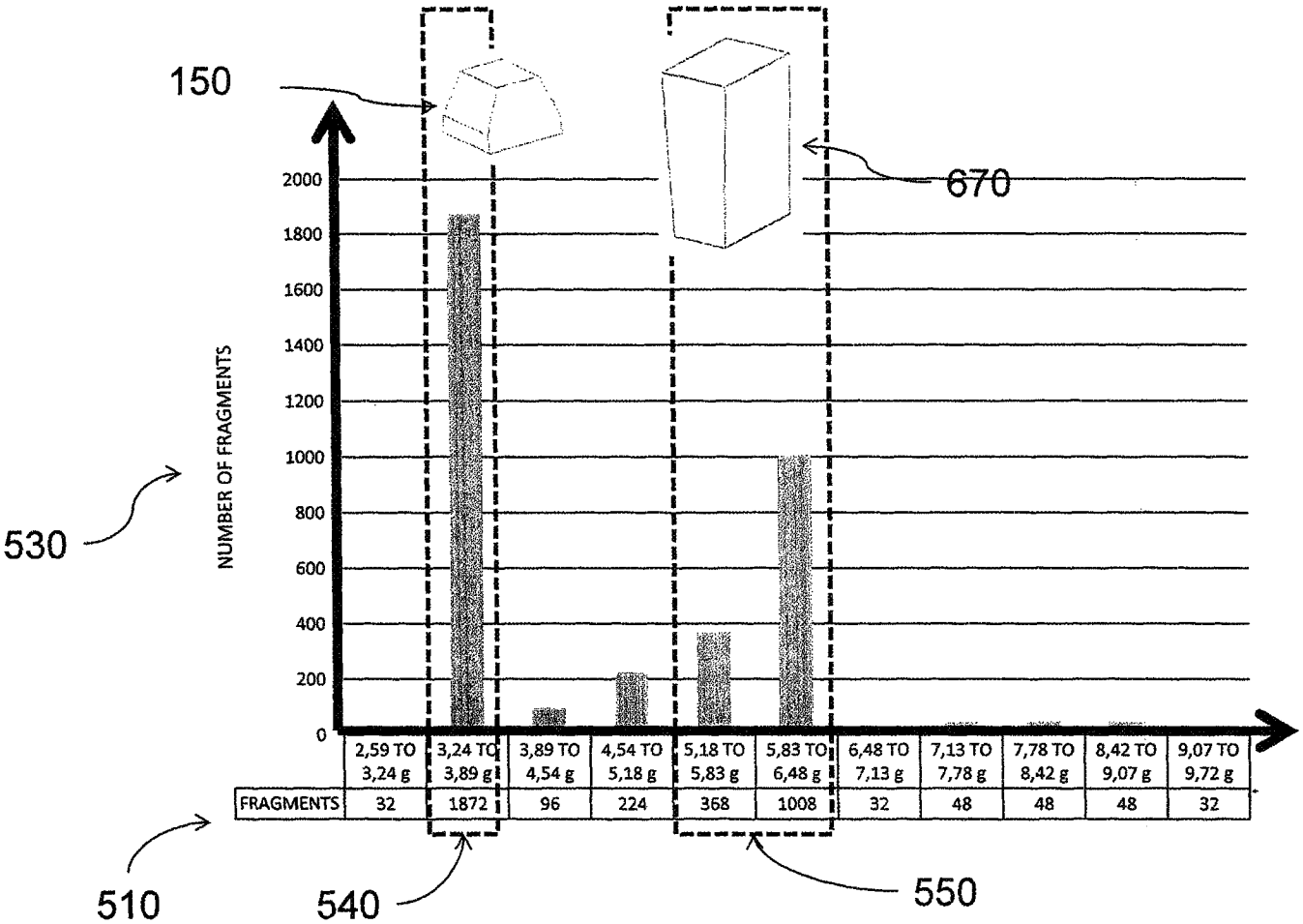
Figure 5E – Estimated 55mm Fragment Distribution (total fragment count)

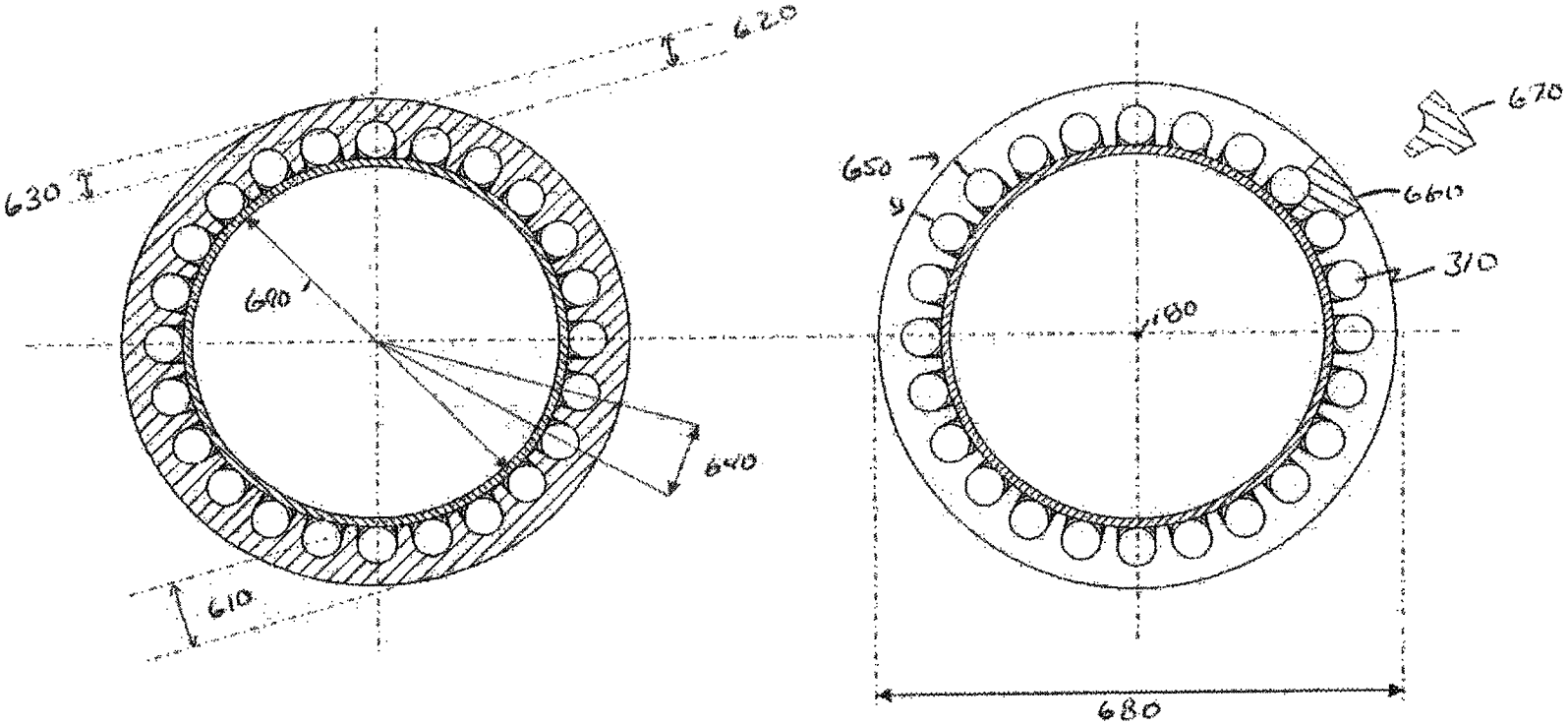
6A – Cross Sectional View of 40mm Warhead Assembly

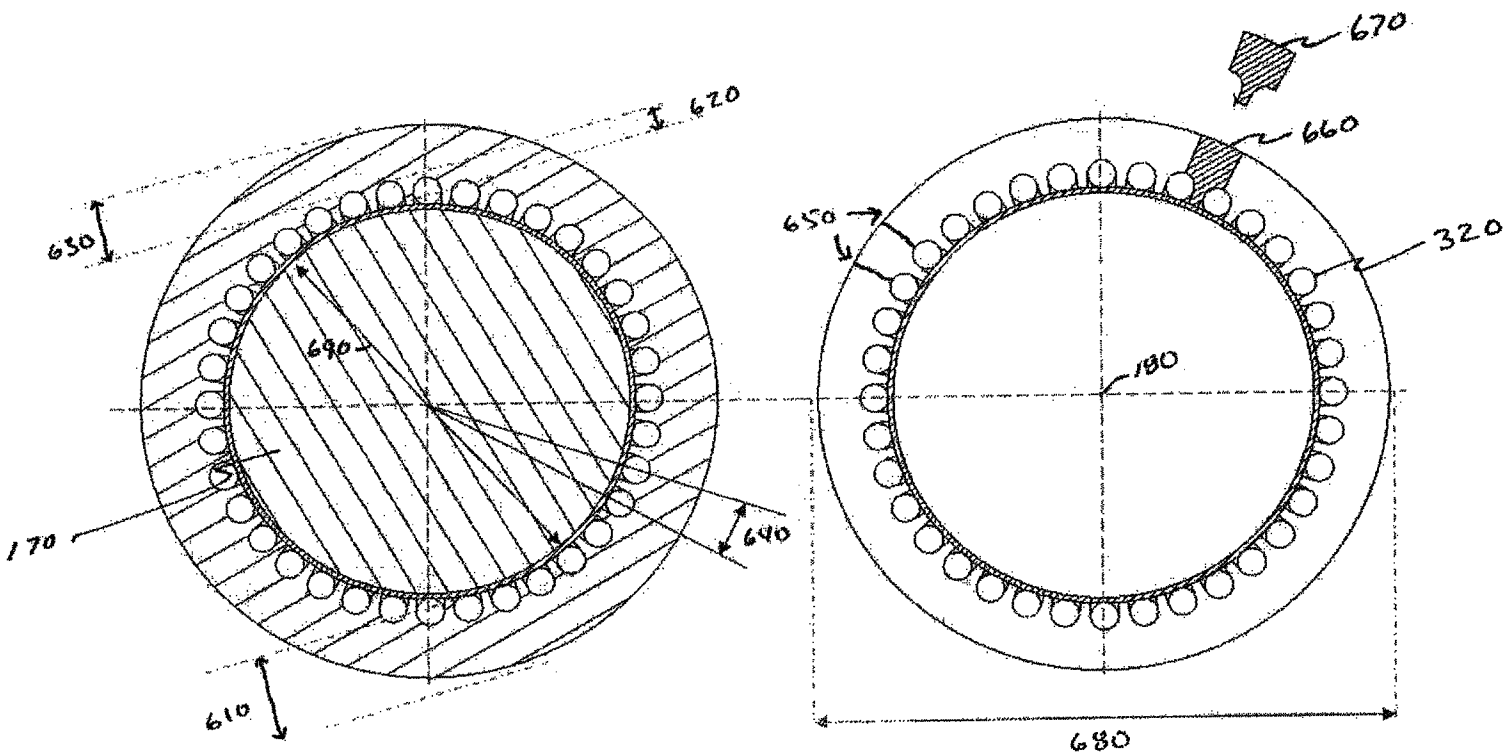
6B – Cross Sectional View of a 105mm Warhead Assembly

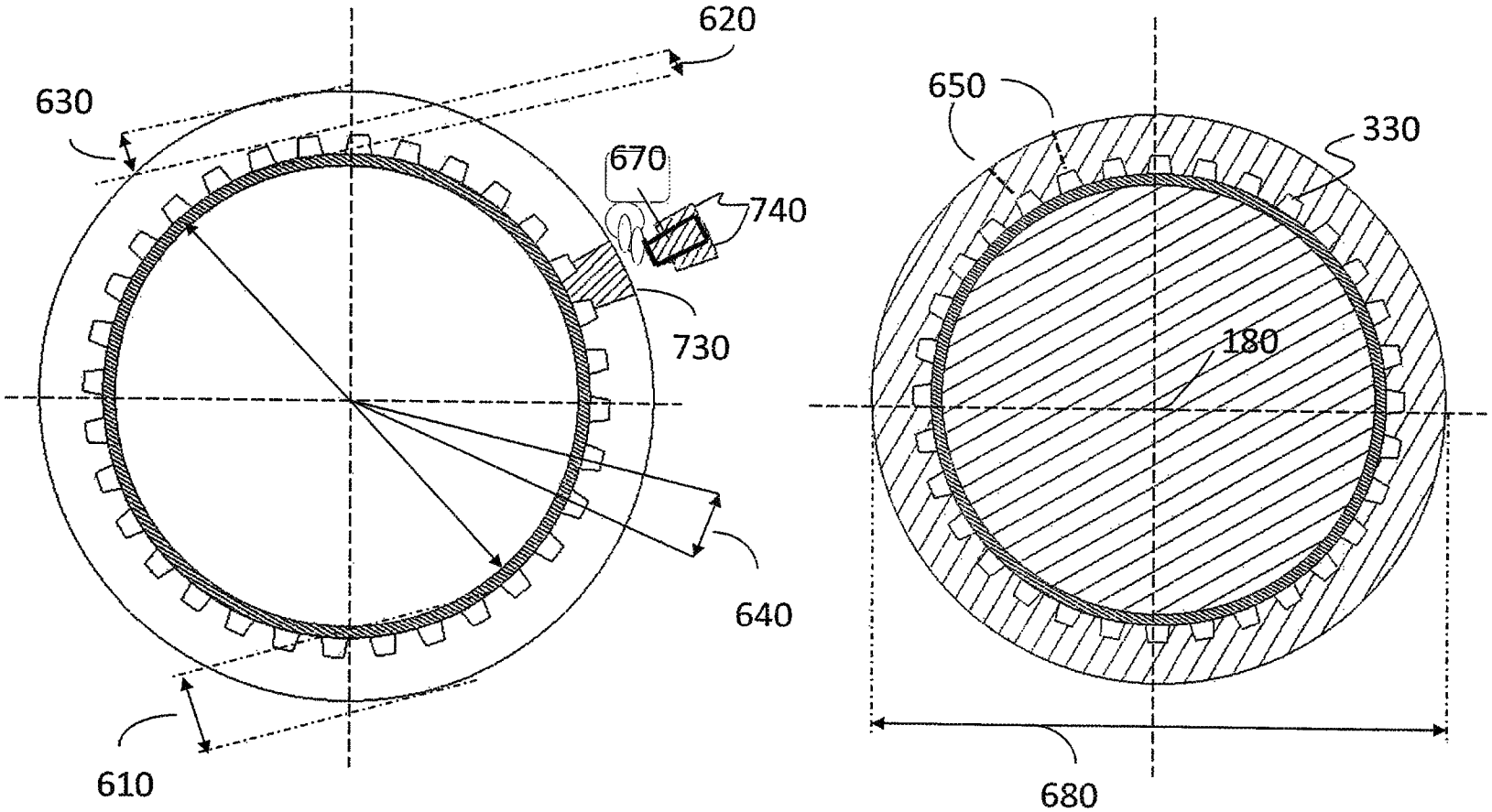
6C – Cross Sectional View of a 155mm Warhead Assembly

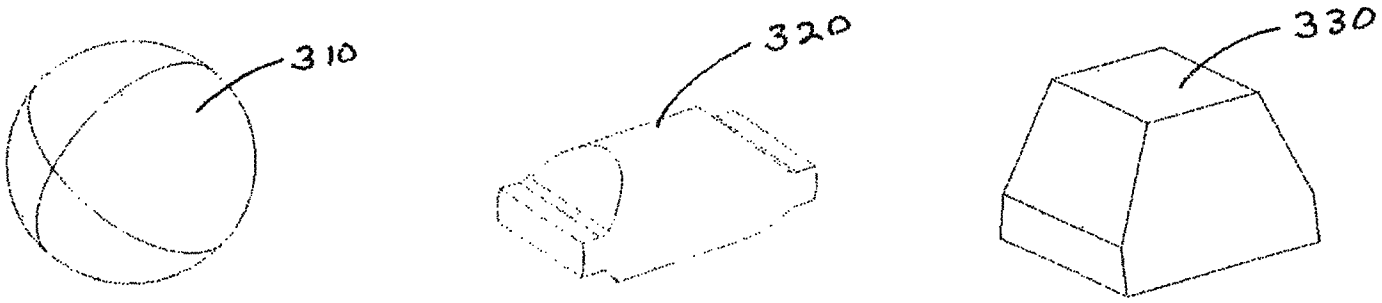
7A – Image of Pre-Formed Fragments

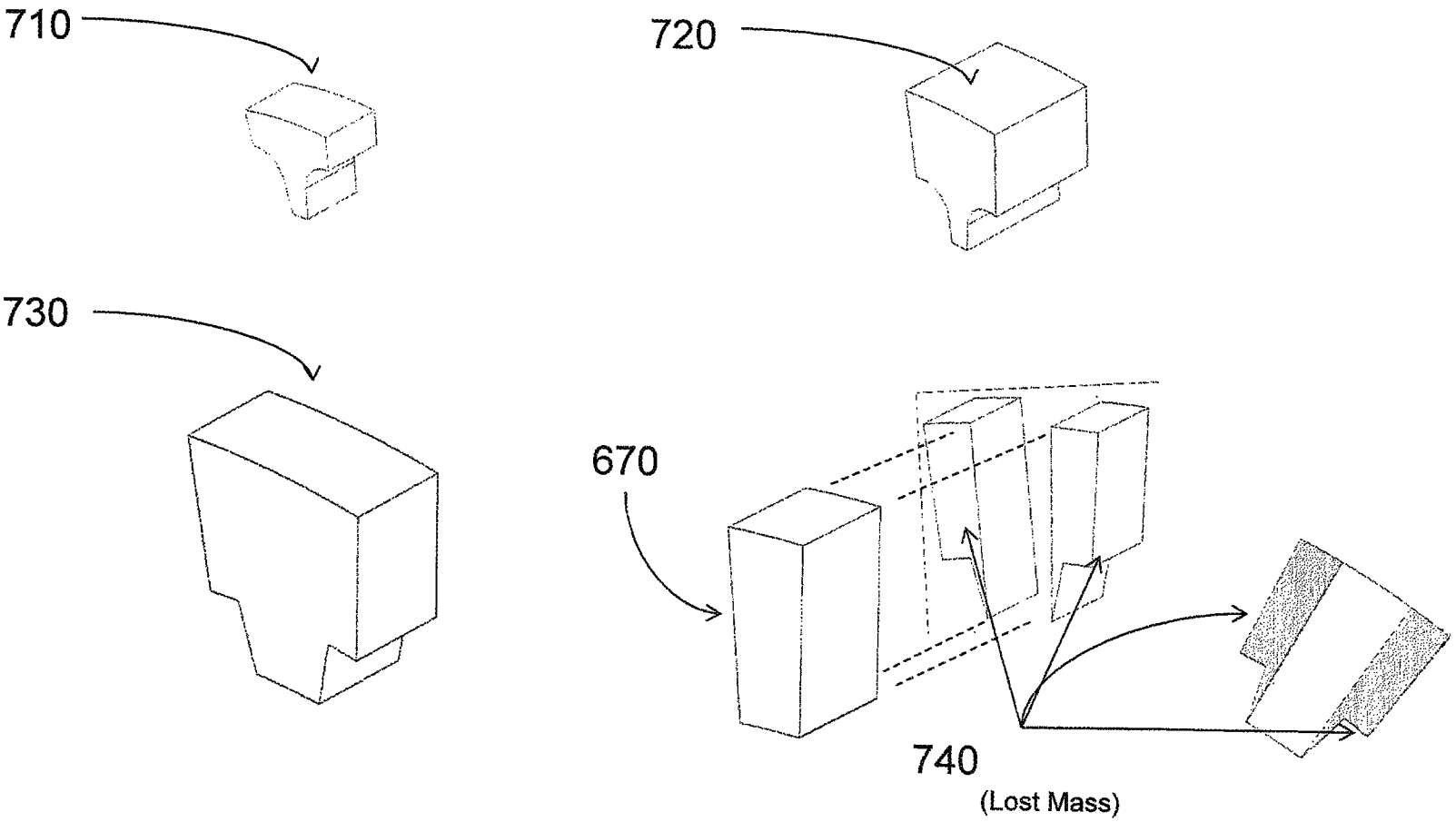
Figure 7B Images of Fragments from the Warhead Body

LOW COLLATERAL DAMAGE BI-MODAL WARHEAD ASSEMBLY

CROSS REFERENCE TO RELATED APPLICATION

This present application claims benefit of priority from U.S. Provisional Application Ser. No. 62/126,767, filed Mar. 2, 2015, entitled "Bi-Modal Warhead".

BACKGROUND OF THE INVENTION

The progression of technology allowing ordnance engineers to improve warheads has often been constrained by metallurgical limitations. Most warhead development prior to the 1980s was based on ordnance engineers finding a precise combination of metallurgy and explosive that delivered good fragmentation. Metals used in ordnance typically exhibit properties of high yield strength across most operational temperature ranges. The use of specialized steels frequently requires vendors to acquire batches of low usage steel from a selective group of US steel mills. During the cold war era, when the US planned for large volume purchases and ammunition, the sustainment of war stocks necessitated reliance on this supply chain paradigm. Often further heat treating, knurling and forming of metals have been used in warheads to further optimize fragmentation. A good example of the matching of specified steel and explosives is the US M430 40 mm cartridge that uses a specific steel, production processes and heat treatment specifications to produce the required fragmentation. One should note that this combination of precision metallurgy and choice of explosive often remains a best value solution as exemplified by the US Air Force (USAF) recent decision to specify a high yield strength ES-1 steel to be used in USAF ordnance. There are significant advantages to metal body warheads but one must also recognize that when using natural fragmentation (1) a proportion of the metal is transformed into very small fragments (or dust) which is ineffective when trying to defeat both anti materiel and antipersonnel targets, and (2) the formed warhead metal body, without knurling or forming, generally produces a detonation with a wide distribution of fragmenting mass. Scoring or otherwise imparting impressions on warhead steel can improve the distribution of fragment mass resulting from a detonation, but lethally effective fragmenting mass is still lost in the process of detonation.

DPICM and UXO:

The US Artillery Corps in the 1970s selected the Dual-Purpose Improved Conventional Munition (DPICM) as the principal ordnance in rocket and large caliber projectile warheads to defeat anti materiel and antipersonnel targets. The US produced large volumes of DPICM 155 mm artillery projectiles and rockets. The DPICM purchases required high volume production of bomblets. These bomblets employed natural fragmentation grenades that also incorporated conical shape charges to improve their anti materiel capability. Unfortunately, the high dud rate of DPICM, which incorporated numerous sub-munitions, gave rise to enormous clean-up costs after the First Gulf War. Subsequent use exhibited high dud rates in certain Middle East conflicts and led to many countries agreeing to ban DPICM technology (see the Dublin Convention on Cluster Munitions). With DPICM as their principal projectile, the US Artillery Corps found itself sidelined in much of the Iraq conflict as their DPICM artillery shells created too much collateral damage and too much UXO to be used in the vicinity of Iraqi population centers.

Medium Caliber Use of Preformed Fragmented Warheads:

As we entered the twentieth century, one sees increasing use of pre-fragmentation, and these pre-fragmentation architectures were being introduced into many military products. Many patents were awarded depicting unique combinations of warheads as prominent ordnance companies began to utilize pre-fragmenting bodies. The German company Diehl incorporated pre-fragmented wire and spheres encased in resin that produced an effective medium caliber warhead assembly that US SOCOM incorporated into NAMMO's MK285 cartridge. The Oerlikon company in Switzerland developed a medium caliber AHEAD warhead that optimized performance in ground-to-air applications. This technology was fielded with the Danish and Dutch Armies in a 35 mm weapon system. Nevertheless, it must be recognized that the vast preponderance of US produced medium caliber munitions relied on the solutions pioneered in the 1970s.

Large Caliber Use of Preformed Fragmented Warheads:

The South African company Denel developed and later, after formation of Rheinmetall Denel Munitions (Phy) Ltd (RDM), produced an effective artillery shell where preformed fragments (PFF) are encased within two metal cones forming the body of a unitary high explosive artillery projectile. Having a need to field a new unitary projectile that minimized collateral damage while defeating two target sets, the US Government contracted with General Dynamics to import this product from South Africa. In the last few years, this 105 mm High Explosive Preformed Fragments (HE-PFF) projectile has been qualified as the US M1130 105 mm Artillery Shell. While the US government obtained data rights for this South African designed projectile, no US producer manufactures the projectile's components and the US production base is not organized to produce this product. A cutaway of the "XM1130" projectile was publically exhibited for three days in Washington D.C., 10-12 Oct. 2011, in the General Dynamics (GD) booth at the Annual United States Army Association Meeting and Show. The 2011 GD display showed a cross section cutaway model of the XM1130 warhead with preformed fragments in a conical formation wedged within two projectile bodies. The warhead uses both natural fragmenting bodies and spherical metal preformed fragments that delivered a bimodal distribution of fragments upon detonation. In the realm of Artillery, therefore, South African ordnance designers have pioneered the science of combining pre-fragmentation with naturally fragmenting metal bodies to produce a bimodal fragment distribution. This bimodal distribution was attractive to the United States Army after the Army (1) analyzed target sets, and (2) decided that the use of a unitary warhead was the best overall design to meet user requirements. With this artillery hardware imported from South Africa and with the challenging task of organizing cost effective production within the US National Technical Industrial Base (NTIB) it remains unclear how this technology will be economically transitioned into the United States.

Utility of Flow Forming Production Technology:

Flow forming of metal bodies began to be utilized in the production of US ordnance in the 1990s. This flow forming process progressively moves metal or blended metals into cylindrical forms with a dense and sturdy metallurgy. To date, most use of flow forming of ordnance since the 1990s has been in the production of rocket motor cases. It is noteworthy that this production process can produce high strength, thin walled cylindrical or conical metal shapes with minimal tolerance variation. The flow forming process can produce complex geometries provided those geometries can be formed on a mandrel.

Liners:

In the last decade the US Army Research Development and Engineering Center (ARDEC) has funded developmental advances in the use of liners or sleeves to mitigate impact threats as determined by Insensitive Munitions (IM) testing.

Notable Prior Art (Patents):

There is a plethora of prior art in scoring and embossing of metal plates and fragmentary components. US Navy U.S. Pat. No. 3,566,794 identified how multi-walled warhead casings can be useful to ordnance designers. The UK MOD U.S. Pat. No. 4,398,467 taught the use of notched rods or wire in warheads. The Hughes Aircraft Company U.S. Pat. No. 4,313,890 taught the inclusion of preformed fragments in a tubular outer casing. Rheinmetall's U.S. Pat. No. 4,982,668 taught a fragmenting body with pre-fragmentation on the outer face of the warhead. The US Navy's US Invention Registration No. H1047 taught the use of notched rods to adjust warhead fragmentation. The US Navy U.S. Pat. No. 5,040,464 identifies methods to control a fragmentation mix. The Diehl U.S. Pat. No. 5,979,332 provided a configuration optimizing fragmentation with wire and preformed fragments set in a resin. This intellectual property was adopted by US SOCOM and incorporated in the US MK285 Air-Burst Cartridge. Rheinmetall's European Patent EP0433544A1 identified unique and useful casing configurations. Giat's U.S. Pat. No. 6,857,372 taught how the use of scoring on inner and outer projectile bodies can influence the fragmentation of the metal case. The US Army U.S. Pat. No. 7,886,667 taught how the use of liners to produce temporal delays in detonation waves assisting in optimizing the fragmentation of a warhead body.

Notable Prior Art (Published Design Information):

The US Navy Air Warfare Center Weapons Division pioneered methods of controlled fragmentation known as the "Person V-notch" in the 1960s and these methods were recently incorporated by the Russians into their 122 mm GRAD 9M22U warhead body. The company PRETIS in Bosnia Herzegovina has also incorporated the US Navy method into their 128 mm M777 product. Bofors 40/57 mm 3P (Pre-fragmented Programmable Proximity) ammunition, introduced to the market in the late 1990s, incorporated preformed fragments encased in two metal bodies. Diehl DM261A2 (HE-PFF) also includes an interesting design of encased preformed fragments within a metal body. One should note that the US Marine Corps developed an interest in the Saab (formerly Ruag Switzerland) MAPAM mortar technology buying test samples that delivered impressive, reliable fragmentation. It should also be recognized that some warhead designs are unpublished because of national security sensitivities. As previously discussed, the RDM M1130 warhead design with preformed fragments is useful validating prior art and providing an example of a warhead with a bimodal distribution of fragments. The concept disclosed herein is an alternative to RDM's disclosed prior art.

Target Defeat Analysis and Terminal Effects:

The mechanics of good ordnance engineering and design start with the analysis of targets and terminal effects. Targets frequently are susceptible to damage from the impact of fragments with certain size, mass and energy but target sets must be analyzed based on realistic situations. For example, an upright soldier in a uniform may be highly susceptible to incapacitation by fragments of various sizes traveling at a high velocity. By contrast the soldier wearing a flak jacket and helmet positioned in a bunker, may be almost invulnerable to incapacitation if (1) the fragments are too small and (2) the density or spray of fragments are too low. Moreover, the small irregular fragments normally produced by the natural fragmentation of warhead bodies may not retain good ballistic flight characteristics or uniform size so these fragments may not penetrate enemy flak jackets or helmets. Flak jackets and helmets can certainly be defeated by fragments with adequate velocity, mass and ballistic characteristics. Accordingly, a target analysis, in a realistic combat situation may indicate that a distinct bimodal fragment distribution size can provide a better optimized terminal effect to defeat a particular set of targets.

Optimizing Larger Warheads:

An obvious challenge emerges as the US Army begins development of its next generation unitary artillery warheads. The Army does not have the financial resources to restart a Crusader type program so it will continue to use the M109 Paladin and M777 series 155 mm×39 caliber shells, adding rocket assisted projectiles (RAP), base bleed technology and precision guidance. Precision guidance kits (PGK) have been perfected and provide precision and flight course adjustment offsetting the errors resulting from RAP and base bleed propulsion. The use of RAP or base bleed technology inevitably reduces the warhead weight relative to the overall projectile weight. In this situation there is obvious pressure on ordnance designers to optimize fragment effects on targets. Since military users also desire a reduction in collateral damage incidents, where militaries intend to destroy targets that are in close proximity to non-combatants, ordnance engineers must find designs that reliably and repeatedly fragment a warhead such that the target is incapacitated while minimizing the throw of fragments beyond the intended terminal effect zone.

Optimizing Medium Caliber and Air Bursting Fragmenting Warheads:

Medium caliber warheads have significantly less weight than larger tank, mortar and artillery warheads. Medium caliber ammunition designers must therefore devise novel approaches to optimize warhead body fragmentation. Moreover, US and NATO forces are now demanding the ability to kill targets in defilade. In the generally accepted systems approach, defeating targets in defilade with medium caliber ammunition will continue to use time fuzes and fire control devices of the type pioneered by US SOCOM when they adopted GD's MK47 weapon system firing NAMMO MK285 ammunition.

Fragment Throw and Collateral Damage:

Ammunition relying solely on natural fragmentation from the warhead body inevitably generates fragments of widely varying mass distribution. The introduction of notching, scoring, knurling or other techniques can produce fragments with less variation but fragments may still retain significant size and energy or fragments may be both undersized and oversized. Undersized fragments have minimal terminal effect. Oversized targets generally can prove dangerous and produce collateral damage beyond the desired terminal effect zone as large fragments are ejected with more energy at long distances from their impact point. These larger fragments, with significant impact energy, can kill and injure non-combatants far from the impact point. In the era of precision strikes, the mass destruction typically caused on targets by artillery is problematic and can infringe on accepted standards of modern warfare. Hence, modern ordnance engineers strive to insure that the fragment size and velocity produced at detonation (1) successfully defeat the desired targets while (2) precluding collateral damage beyond the intended target or target set. The reliable creation of fragments (density, size and velocity) with specified mass range is desired. Further, in many cases a reliable bimodal distribution of fragments is required to impart a desired terminal effect on two target sets while minimizing collateral damage.

Fragment Shape and Velocity:

The natural fragmentation arising from the detonation of warhead bodies produces fragments with irregular shapes and irregular surfaces. These fragments are propelled by the expanding gases forming multiple shockwaves as the fragments travel beyond the sound barrier. These irregular shapes and surfaces induce drag and turbulence about the fragments which rapidly degrade the velocity and range of these "natural" fragments. Preformed fragments, particularly spheres, by contrast have aerodynamically smoother surfaces that provide better ballistic flight (reduced drag) from the detonation point.

Fragment Throw and Safe Separation:

Further, when using high velocity cartridges, such as 30 mm×173 ammunition, the forward speed of the projectile may inhibit the effectiveness of high speed "rearward" fragments. By contrast, lower velocity ammunition such as 40 mm×53 projectiles travel slow enough to propel fragments rearward, such that the fragments can still effectively defeat targets. The ejection of fragments at right angles to the flight path for medium caliber ammunition represents an optimum defilade kill geometry. A medium caliber cartridge must meet the safe separation safety requirements for a system. As an example, the US M430 cartridge exhibits inadequate safe separation. Hence, the Army must train gunners using MK19s (40 mm AGL) to never fire at targets less than 300 meters away unless the commander deems it acceptable to expose friendly forces to rearward fragments of the M430 cartridge. US SOCOM has adopted the MK285 cartridge from the MK47 (40 mm AGL) with a safe separation distance of less than 100 meters. This improved safe separation of the MK285 cartridge allows US SOF forces to engage enemy targets at shorter ranges relative to their US Army counterparts. Where a warhead designer is able to design warheads that reliably fragment and throw fragments rearward where these fragments are of a limited size and mass, such a projectile will have optimized safe separation from the gunner. Stated another way, where a warhead does not produce heavy high velocity fragments thrown rearward, that warhead will have a better optimized safe separation allowing friendly forces to use weapons at closer range.

The prior art incorporated into most US designs was developed in the 1970s. In an age of air burst munitions, precision time fuzes, Insensitive Munitions (IM) Technologies and Precision Guidance Kits the continued use of older "metal-explosive warheads" has the downside that the technique generally creates a wide distribution of fragmenting mass without distinct nodes. Many fragments generated by natural fragmentation of warhead bodies are produced in a mass range (and with kinetic energy) that lacks effect on targets and produces an unacceptable danger of collateral damage.

Summary:

The referenced fielded US projectiles discussed in this patent application are warheads used in gun fired ammunition. Warheads are also widely utilized in missiles and rockets. The warheads for missiles have different design constraints. Gun fired warheads, especially those that are spin stabilized, must undergo high setback forces and require adequate gyroscopic stability. Missiles and rockets have other different and demanding design requirements.

At this crossroads in the history of military technology, there is a need to provide novel warhead designs that (1)(a) reliably produce bimodal or (b) multimodal fragment distribution, with (c) a correspondingly optimized terminal effect on a target or target set, that also (2)(a) minimize collateral damage and (b) deliver adequate safe separation.

SUMMARY OF THE INVENTION

A principal object of the present invention is to provide a warhead assembly that meets the requirements outlined above.

This object, as well as other objects which will become apparent from the discussion that follows are achieved, in accordance with the present invention, by providing a warhead assembly, designed to be mounted at the head of a missile or projectile for delivery to a target, which comprises a round metal body having an inner wall with a plurality of channels or grooves extending parallel to a central longitudinal axis. Preformed fragments are inserted in the channels or grooves and a liner with an explosive fill is positioned within the metal body, retaining the preformed fragments in place and separating them from the explosive fill. The warhead assembly on detonation generates a bimodal distribution of fragments with adequate mass and velocity to create an optimized mixed fragmentation effect that can defeat a target fitted with differing ballistic protection and/or mixed targets of both enemy vehicles and personnel.

More particularly, the warhead assembly according to the present invention comprises:

(a) A round metal casing having an outer surface with an aeroballistic shape and an inner wall with a plurality of grooves extending parallel to a central longitudinal axis. The grooves are of such a size as to contain and fit preformed fragmentation elements.

(b) A plurality of preformed metal fragmentation elements disposed in the grooves in the casing and balanced to provide for stable gyroscopic spin of the warhead assembly and its delivery missile or projectile when in ballistic flight.

The distances between the grooves along the casing surface and the depths of the grooves produce fragmentation of the warhead body upon detonation, thereby substantially shaping the fragmentation. The combined effect of the metal casing fragmentation and the preformed fragmentation elements creates a "terminal effect", exhibiting a multimodal distribution of fragments with an optimized target effect, defeating a single target or a mixed target (enemy vehicles and personnel).

Preferably, the grooves extend forward along the inner wall of the casing from the vicinity of a base thereof, which is attachable to the missile or projectile, toward a nose thereof.

The grooves can either extend rearward along the inner wall of the casing from the vicinity of the warhead nose toward a base thereof, or extend along the inner wall of the casing from the vicinity of the toward the nose.

The shaping of the warhead casing fragments on detonation is influenced by the preformed metal fragmentation elements interacting with the overall geometry of the metal casing. This can be determined by properly selecting one or more of the following parameters:

(a) casing wall thickness, (b) distance between the casing grooves, (c) depth of the casing grooves, (d) type of metal forming the casing, and (e) a forming process used in producing the casing.

According to the invention, the preformed metal fragmentation elements fit tightly into the inner channels of the grooves and thereby substantially retain their form after detonation. The shape of the preformed metal fragmentation elements preferably includes one or more of spheres, notched rods, wire and cylindrically shaped rods.

According to a particular feature of the present invention, the warhead assembly comprises a nose cap incorporating a fuze that initiates a detonation in a designated post firing or launch environment. It may also comprise a liner, housing an explosive fill, positioned within the casing and retaining the preformed metal fragmentation elements in place. The liner physically separates the preformed metal fragmentation elements from the explosive fill.

The metal casing and the preformed metal fragmentation elements fitted into the grooves together with the liner form a configuration that mitigates the impact threat from an assailant projectile or fragment deep penetration into the cavity housing the warhead assembly's explosive fill.

For a full understanding of the present invention, reference should now be made to the following detailed description of the preferred embodiments of the invention as illustrated in the accompanying drawings.

BRIEF DESCRIPTION OF THE DRAWINGS

FIG. 1A shows cutaway views of a 40 mm warhead assembly according to a preferred embodiment of the present invention.

FIG. 1B shows cutaway views of a 105 mm warhead assembly according to a preferred embodiment of the present invention.

FIG. 1C shows cutaway views of a 155 mm warhead assembly according to a preferred embodiment of the present invention.

FIG. 2A is a view of a 40 mm warhead body with internal grooves according to a preferred embodiment of the present invention.

FIG. 2B is a view of a 105 mm warhead body with internal grooves according to a preferred embodiment of the present invention.

FIG. 2C is a view of a 155 mm warhead body with internal grooves according to a preferred embodiment of the present invention.

FIG. 3A is a view of a 40 mm projectile with spherical pre-fragments according to a preferred embodiment of the present invention.

FIG. 3B is a view of a 105 mm projectile with cylindrical or notched wire preformed fragments according to a preferred embodiment of the present invention.

FIG. 3C is a view of a 155 mm projectile with notched rods according to a preferred embodiment of the present invention.

FIG. 4A is a view of a 40 mm liner and spherical preformed fragments according to a preferred embodiment of the present invention.

FIG. 4B is a view of a 105 mm projectile liner and cylindrical or notched wire preformed fragments according to a preferred embodiment of the present invention.

FIG. 4C is a view of a 155 mm line and notched rod preformed fragments according to a preferred embodiment of the present invention.

FIG. 5A shows typical bimodal distributions for a warhead assembly according to the present invention.

FIG. 5B shows a typical multimodal distribution for a warhead assembly according to the present invention.

FIG. 5C shows a multimodal distribution with confidence levels for a warhead assembly according to the present invention.

FIG. 5D shows an estimated 155 mm fragment mass distribution (total Fragment Weight) for a warhead assembly according to the present invention.

FIG. 5E shows an estimated 155 mm fragment mass distribution (total Fragment Count) for a warhead assembly according to the present invention.

FIG. 6A is a cross sectional view of a 40 mm warhead assembly according to a preferred embodiment of the present invention.

FIG. 6B is a cross sectional view of a 105 mm warhead assembly according to a preferred embodiment of the present invention.

FIG. 6C is a cross sectional view of a 105 mm warhead assembly according to a preferred embodiment of the present invention.

FIG. 7A is a diagram of preformed fragments for a warhead assembly according to the present invention.

FIG. 7B is a diagram of fragments from a warhead body according to the present invention.

DESCRIPTION OF PREFERRED EMBODIMENTS

The preferred embodiments of the present invention will now be described with reference to FIGS. 1-7B of the drawings. Identical elements in the various figures are designated with the same reference numerals.

Assembly:

FIG. 1 depicts a view of 40 mm bimodal warhead assembly. FIG. 2 depicts views of a 105 mm bimodal projectile assembly. FIG. 3 depicts views of a 155 mm bimodal projectile body. The warhead assembly includes a fuze (110), and may include a body form (120). The warhead body (130) may also include a driving band (140). The warhead body (130) includes channels or grooves (220) that when assembled house preformed fragments (150). Where setback forces or loading techniques necessitate, a liner (160) may be added to retain the preformed fragments (150) in position and separate the explosive fill (170), and simplify the loading of an appropriate explosive fill. The axis of rotation (180) is also depicted about which the fragment (density) and location are matched in each channel providing the warhead with good gyroscopic balance characteristics.

Liner:

FIGS. 1-3 depict how the liner (160) firmly fits to the warhead's metal body (130) and the preformed fragments (150). An explosive fill (170) is cast, pressed or melt poured into the liner. FIGS. 4A-4C illustrate how the liner interfaces with the preformed fragments (150). The liner (160) can be constructed with a density and geometry to mitigate impact and insulate the explosive from aerodynamic heating encountered in flight.

Preformed Fragments:

FIGS. 4A-4C and FIG. 7A depict how pre-fragmented fragments (150) are metal spheres (310), cylinders produced with cut metal rods or cut wire (320), or notched rods (330).

Warhead Body:

FIGS. 2A-2C depict how the warhead body (130) includes channels or grooves (220). FIGS. 6A-6C cross-sectional views that depict grooves (220), included as a feature in the inner diameter (690) of a warhead body (130). In medium caliber projectiles such as the 40 mm warhead body depicted in FIG. 2A, channels may be produced from progressive metal work such as flow forming and post forming machining. In large projectiles, as depicted in FIGS. 2B and 2C, channels may be forged or cast and/or machined. The channels, grooves and preformed fragments, when viewed from the side orientation of the projectile, are parallel or conical to the axis of rotation (180) as seen in the side cutaway views in FIGS. 1A, 1B and 1C. The construction materials and geometry, with groves housing preformed fragments, provide a highly gyroscopically balanced warhead assembly about the axis of rotation (180). The cross sectional views of FIGS. 6A-6C depict features such as warhead body (max) wall thickness (610), depth of grooves (620), warhead body wall thickness (min)(630), and placement of preformed fragments (150) and a liner (160) filled with an explosive (170) about the center of rotation (180).

Fracture Mechanics and Physics Creating Fragments from the Warhead Body:

Again referring to FIGS. 6A-6C it is useful to discuss how detonation creates fragments out of the warhead body (130). In the initial microseconds after the initiation of a warhead detonation, pressure expands the warhead body (130) until the stretching metal yields creating a symmetrical fracture (650) in the vicinity of warhead body's thinnest wall (620). The fracture (650) induced at detonation by the wall yielding occurs under the tremendous expansion pressure of detonation. The underlying metallurgy, grooves (220) housing preformed fragments (120) influence the creation of fragments at detonation as the groove to groove spacing (640) and depth of the grooves (620) and the wall thickness (610) produce in detonation a fragment of a predictable size (670). The fragmentation of the other wall may result in the loss of some metal mass (740) which is effectively transformed into unrecoverable micro fragments. With fracture of the outer case, pre-fragmented metal (120) housed in the channels is propelled and enveloped by the escaping gases of detonation. While the process of detonation may slightly reduce the mass of a pre-fragmented projectile (120), these fragments are ejected at high velocity based on the warhead assembly's orientation.

Post Detonation Fragment Distribution:

Reference to FIGS. 5A-5E is useful in considering the generation of fragments. Post detonation recovery of fragments verifies that the detonation of warheads based on designs according to the invention produces a bimodal (or multimodal) distribution of fragments where a horizontal scale (510) categorizes recovered fragments, a vertical scale categorizes fragment weight (or mass) (520) and fragment count (530) where the pattern of fragments includes at least two modes (540, 550) about a mean value (570) and median value (580). The fragment pattern distribution is identified with greater degrees of confidence (592, 594, 596) which is useful in establishing the likelihood that the warheads will create unintended collateral damage.

Bimodal or Multimodal Distribution of Fragments:

When operating against a single target, fragments produced from detonation of the assembly have a bimodal distribution (540, 550) to incapacitate targets with both fragments from the warhead body (670, 710, 720, 730) and preformed fragments (150). A bimodal (540, 550) multimodal (540, 550, 560) distribution of fragments is useful in defeating certain targets or target sets as set forth in the following example:

A bimodal or multimodal distribution of fragments are useful in defeating a single target as provided in Example 1.

Example 1:

An enemy soldier with a flak jacket creates a difficult target to incapacitate inasmuch as a certain geometry, mass and velocity will optimize performance in penetrating a flak jacket while a different geometry, mass and velocity will optimize performance against exposed limbs.

In other cases, when operating against multiple targets (a target set composed of both enemy soldiers and equipment), a bimodal distribution of fragments is desired, so that a different velocity, fragment mass and geometry is an optimized defeat mechanism for mixed targets.

Example 2:

To defeat a mixed target set with a unitary warhead is challenging. To defeat such targets, the impact energy of larger fragments should produce a desired terminal effect against vehicles while smaller fragments spread with a greater density (spacing) in the target area producing a desired incapacitation of enemy soldiers.

Geometry of Inset Channels and Warhead Body Fragmentation:

The outer warhead has a maximum wall thickness (610), groove depth (620) and a minimum wall thickness (630) and a specified groove-to-groove radial spacing (640). The foregoing geometry induces the creation of a fracture point (650) at the thinnest point in the warhead wall at detonation, such that the warhead body provides adequate structural strength at setback and in flight. The liner (150) fits into the warhead body's inner diameter (690). Fragmentation is directly influenced by groove depth (620), radial spacing (640) and the shape of the channels or grooves (220) in the warhead. The size of fragments produced by detonation of the warhead body (710, 720, 730 and 670) produce one mode (550) as depicted in FIG. 5A, 5B or 5C. Some mass of the outer wall may be lost as a result of detonation (740).

Characteristics of Preformed Fragments:

The explosive fill (140) is cast, pressed or melt-poured into the liner as depicted in FIGS. 1A-1C. At detonation, preformed fragments are ejected at a velocity and a reliable size that, measured after recovery, fall within a specific measured mode (540).

Multimodal Rear Fragmentation:

At the rear of a 40 mm projectile, a designer may wish to provide adequate confidence in "safe separation" to protect the gunner firing the projectile. Since a variation of design at the rear of the warhead may not degrade the gyroscopic balance of a projectile, it is possible to introduce a multimodal design with rearward fragment throw that varies from the side fragments thrown from a projectile. In these circumstances, the rearward fragments optimized for short range effect, while still affording safe separation, would create a third mode (560) when the fragments are recovered.

There has thus been shown and described a novel bimodal warhead assembly which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

REFERENCE NUMBERS

110 Fuze
120 Body Form
130 Warhead Body
140 Driving Band

150 Preformed Fragments
160 Liner
170 Explosive Fill
180 Axis of Rotation
210 Fuze Well
220 Channels or Grooves
310 Metal Spheres
320 Notched Wire or Forms Using Cylinders
330 Notched Rods
510 Horizontal Scale—Weight Category of Fragments from Warhead Assembly
520 Vertical Scale A—Total Weight of Fragments by Weight Category
530 Vertical Scale B—Number of Fragments by Weight Category
540 Mode 1
550 Mode 2
560 Mode 3
570 Mean Value
580 Median Value
590 Distribution
592 Distribution with 1σ Confidence
594 Distribution with 2σ Confidence
596 Distribution with 3σ Confidence
610 Warhead Body (Max) Wall Thickness
620 Depth of Grooves
630 Warhead Body (Min) Wall Thickness
640 Groove to Groove Radial Separation
650 Outer Body Fracture Point
660 Fragment Location
670 Estimated Fragment Size from outer wall
680 Outer Diameter
690 Inner Diameter
710 40 mm Outer Wall Fragment
720 105 mm Outer Wall Fragment
730 155 mm Outer Wall Fragment
740 155 mm Outer Wall Fragment with Mass Loss

What is claimed is:

1. A warhead assembly, adapted to be mounted at the head of a missile or projectile designed to deliver the warhead assembly to a target, said warhead assembly comprising, in combination:

(a) a round metal body having an inner wall with a plurality of grooves extending parallel to a central longitudinal axis of the metal body;

(b) a plurality of preformed fragments inserted in the grooves in said inner wall;

(c) a liner, thinner than said metal body, positioned within the metal body and configured to retain the preformed fragments in place in said grooves; and (d) an explosive fill inside the liner;

whereby the warhead assembly on detonation produces a bimodal distribution of fragments with adequate mass and velocity to create an optimized mixed fragmentation effect on the target that can defeat the target even when it is fitted with ballistic protection and/or when it comprises mixed targets of both enemy vehicles and personnel.

2. A warhead assembly, as recited in claim 1, wherein the liner physically separates the preformed fragments from the explosive fill.

3. A warhead assembly, adapted to be mounted at the head of a missile or projectile designed to deliver the warhead assembly to a target, said warhead assembly comprising, in combination:

(a) a round metal casing having an outer surface with an aeroballistic shape and an inner wall with a plurality of grooves extending parallel to a central longitudinal axis thereof, said grooves being of such a size as to contain and fit preformed fragmentation elements;

(b) a plurality of preformed metal fragmentation elements disposed in said grooves in the casing and balanced to provide for a stable gyroscopic spin of the warhead assembly and its delivery missile or projectile when in ballistic flight; and (c) an explosive charge within the metal casing;

wherein distances between the grooves along the casing surface and depths of the grooves produce a fragmentation of the metal casing such that, on detonation of the explosive charge, the fragmentation is substantially shaped and defined by the grooves;

whereby the combined effect of the metal casing fragmentation and the preformed fragmentation elements creates a terminal effect upon said detonation, exhibiting a multimodal distribution of fragments with an optimized effect on the target that defeats the target when it is either a single target or a mixed target of enemy vehicles and personnel.

4. A warhead assembly, as recited in claim 3, wherein the grooves extend forward along the inner wall of the casing from a vicinity of a base thereof which is attachable to the missile or projectile toward a nose thereof.

5. A warhead assembly, as recited in claim 3, wherein the grooves extend rearward along the inner wall of the casing from the vicinity of a nose thereof toward a base thereof which is attachable to the missile or projectile.

6. A warhead assembly, as recited in claim 3, wherein the grooves extend along the inner wall of the casing from a vicinity of a base thereof which is attachable to the missile or projectile to a vicinity of a nose thereof.

7. A warhead assembly, as recited in claim 3, wherein shaping of the casing fragments, upon detonation, is influenced by effects the preformed metal fragmentation elements interacting with an overall geometry of the metal casing, as determined by at least one parameter selected from the group consisting of:

(a) casing wall thickness, (b) distance between the casing grooves, (c) depth of the casing grooves, (d) type of metal forming the casing, and (e) a forming process used in producing the casing.

8. A warhead assembly, as recited in claim 3, wherein the preformed metal fragmentation elements fit tightly into the grooves' inner channels and thereby substantially retain their form after detonation.

9. A warhead assembly, as recited in claim 3, wherein the shape of the preformed metal fragmentation elements is selected from the group consisting of spheres, notched rods, wire and cylindrically shaped rods.

10. A warhead assembly, as recited in claim 3, further comprising a nose cap fitted to the metal casing, on an end thereof opposite to the end which is fitted to the missile or projectile, said nose cap incorporating a fuze that initiates a detonation in a designated post firing or launch environment.

11. A warhead assembly, as recited in claim 3, further comprising a fuze fitted to the metal casing, at a base thereof which is fitted to the missile or projectile, that initiates a detonation in a designated post firing or launch environment.

12. A warhead assembly, as recited in claim 3, further comprising a liner, housing an explosive fill, positioned within the casing and retaining the preformed metal fragmentation elements in place, said liner physically separating the preformed metal fragmentation elements from the explosive fill.

13. A warhead assembly, as recited in claim 12, wherein the metal casing and the preformed metal fragmentation elements fitted into the grooves, coupled with the liner, form a configuration that mitigates the impact threat from an assailant projectile or fragment deep penetration into the cavity housing the warhead assembly's explosive fill.

14. A warhead assembly, as recited in claim 13, wherein a diversion of an assailant projectile or fragment attack reduces the peak pressure imparted directly on the explosive fill housed in the warhead assembly and thereby reduces the peak pressure point precluding the detonation of the warhead's explosive, reducing the overall sensitivity to outside stimuli of an assailant projectiles or fragments.

* * * * *